US012768003B2

(12) United States Patent
Takeda et al.

(10) Patent No.: US 12,768,003 B2
(45) Date of Patent: Oct. 20, 2026

(54) STEEL SHEET AND METHOD OF PRODUCTION OF SAME

(71) Applicant: NIPPON STEEL CORPORATION, Tokyo (JP)

(72) Inventors: Kengo Takeda, Tokyo (JP); Katsuya Nakano, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 414 days.

(21) Appl. No.: 18/284,036

(22) PCT Filed: Feb. 7, 2022

(86) PCT No.: PCT/JP2022/004732
§ 371 (c)(1),
(2) Date: Sep. 25, 2023

(87) PCT Pub. No.: WO2022/209305
PCT Pub. Date: Oct. 6, 2022

(65) Prior Publication Data

US 2024/0158882 A1 May 16, 2024

(30) Foreign Application Priority Data

Apr. 2, 2021 (JP) ..... 2021-063713

(51) Int. Cl.
*C21D 9/46* (2006.01)
*C21D 6/00* (2006.01)
(Continued)

(52) U.S. Cl.
CPC ..... *C21D 9/46* (2013.01); *C21D 6/001* (2013.01); *C21D 6/002* (2013.01); *C21D 6/004* (2013.01);
(Continued)

(58) Field of Classification Search
CPC ..... C21D 9/46; C21D 6/001; C21D 6/002; C21D 6/004; C21D 6/005; C21D 6/007; C21D 6/008; C21D 8/0205; C21D 8/0226; C21D 8/0236; C21D 8/0263; C21D 8/0278; C21D 2211/001; C21D 2211/002; C21D 2211/005; C21D 2211/008; C21D 2211/009; C21D 8/0273; C22C 38/001;
(Continued)

(56) References Cited

U.S. PATENT DOCUMENTS 4,861,390 A * 8/1989 Satoh ..... C21D 8/0426 148/601
2006/0057417 A1 3/2006 Tada et al.
(Continued)

FOREIGN PATENT DOCUMENTS

JP 2-274856 A 11/1990
JP 4-253503 A 9/1992
(Continued)

*Primary Examiner* — Ricardo D Morales
(74) *Attorney, Agent, or Firm* — Birch, Stewart, Kolasch & Birch, LLP

(57) ABSTRACT

A steel sheet excellent in energy absorption at the time of crushing deformation, that is, steel sheet having a predetermined chemical composition and steel microstructure which has on the sheet surface a plurality of step differences having height differences of more than 5.0 μm at intervals of 2.0 mm or less.

6 Claims, 2 Drawing Sheets

(51) Int. Cl.

| | |
|---|---|
| ***C21D 8/02*** | (2006.01) |
| ***C21D 8/0221*** | (2026.01) |
| ***C21D 8/0247*** | (2026.01) |
| ***C21D 8/0278*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/10*** | (2006.01) |
| ***C22C 38/12*** | (2006.01) |
| ***C22C 38/14*** | (2006.01) |
| ***C22C 38/16*** | (2006.01) |
| ***C22C 38/20*** | (2006.01) |
| ***C22C 38/22*** | (2006.01) |
| ***C22C 38/24*** | (2006.01) |
| ***C22C 38/28*** | (2006.01) |
| ***C22C 38/30*** | (2006.01) |
| ***C22C 38/32*** | (2006.01) |
| ***C22C 38/34*** | (2006.01) |
| ***C22C 38/38*** | (2006.01) |
| ***C22C 38/42*** | (2006.01) |
| ***C22C 38/44*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C22C 38/58*** | (2006.01) |
| ***C22C 38/60*** | (2006.01) |

(52) U.S. Cl.

CPC ..... *C21D 6/005* (2013.01); *C21D 6/007* (2013.01); *C21D 6/008* (2013.01); *C21D 8/02* (2013.01); *C21D 8/0226* (2013.01); *C21D 8/0236* (2013.01); *C21D 8/0263* (2013.01); *C21D 8/0278* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/10* (2013.01); *C22C 38/105* (2013.01); *C22C 38/12* (2013.01); *C22C 38/14* (2013.01); *C22C 38/16* (2013.01); *C22C 38/20* (2013.01); *C22C 38/22* (2013.01); *C22C 38/24* (2013.01); *C22C 38/28* (2013.01); *C22C 38/30* (2013.01); *C22C 38/32* (2013.01); *C22C 38/34* (2013.01); *C22C 38/38* (2013.01); *C22C 38/42* (2013.01); *C22C 38/44* (2013.01); *C22C 38/48* (2013.01); *C22C 38/50* (2013.01); *C22C 38/52* (2013.01); *C22C 38/54* (2013.01); *C22C 38/58* (2013.01); *C22C 38/60* (2013.01); *C21D 2211/001* (2013.01); *C21D 2211/002* (2013.01); *C21D 2211/005* (2013.01); *C21D 2211/008* (2013.01); *C21D 2211/009* (2013.01)

(58) Field of Classification Search

CPC ... C22C 38/002; C22C 38/005; C22C 38/008; C22C 38/02; C22C 38/04; C22C 38/06; C22C 38/08; C22C 38/105; C22C 38/12; C22C 38/14; C22C 38/16; C22C 38/20; C22C 38/22; C22C 38/24; C22C 38/26; C22C 38/28; C22C 38/30; C22C 38/32; C22C 38/34; C22C 38/38; C22C 38/42; C22C 38/44; C22C 38/48; C22C 38/50; C22C 38/52; C22C 38/54; C22C 38/58; C22C 38/60; C22C 38/10; C22C 38/46

See application file for complete search history.

(56) References Cited

U.S. PATENT DOCUMENTS

| | | | | |
|---|---|---|---|---|
| 2009/0014095 | A1* | 1/2009 | Mukai ..... | C22C 38/04 148/320 |
| 2018/0023155 | A1 | 1/2018 | Takeda et al. | |
| 2018/0135145 | A1 | 5/2018 | Suwa et al. | |
| 2019/0071744 | A1 | 3/2019 | Hasegawa et al. | |
| 2022/0042147 | A1 | 2/2022 | Shuto et al. | |

FOREIGN PATENT DOCUMENTS

| | | | |
|---|---|---|---|
| JP | 5-237505 | A | 9/1993 |
| JP | 6-238302 | A | 8/1994 |
| JP | 10-204540 | A | 8/1998 |
| JP | 2004-263295 | A | 9/2004 |
| JP | 2007-291500 | A | 11/2007 |
| JP | 2015-151600 | A | 8/2015 |
| JP | 6791838 | B2 | 11/2020 |
| WO | WO 2016/163469 | A1 | 10/2016 |
| WO | WO 2020/184356 | A1 | 9/2020 |

* cited by examiner

MAXIMUM HEIGHT ROUGHNESS

STEP DIFFERENCE

STEEL SHEET AND METHOD OF PRODUCTION OF SAME

FIELD

The present application discloses a steel sheet and a method of production of the same.

BACKGROUND

In recent years, to realize improvement in the fuel efficiency of automobiles, high strength steel sheet is being used to lighten the weight of automobile bodies. Further, to secure the safety of passengers as well, high strength steel sheet has come to be used in greater amounts for automobile bodies in place of soft steel sheet. To further lighten the weight of automobile bodies, it is necessary to raise the level of strength of high strength steel sheet over the level of the past.

Further, auto parts are required to deform at the time of collision of vehicles to exhibit high energy absorption. To raise the energy which is absorbed due to deformation of auto parts at collision of vehicles, it is desirable to prevent fracture of the steel caused during crushing deformation of the auto parts. For this reason, the steel sheet used for auto parts are required to be both high in strength and to exhibit excellent energy absorption at the time of crushing deformation. However, in the prior art, while the workability of high strength steel sheet etc. have been studied (for example, the following PTLs 1 to 3), the energy absorption at the time of crushing deformation has not been sufficiently studied.

PTL 1 discloses a method comprising cold rolling hot rolled steel strip containing C: 0.3 to 1.3%, Si: 0.03 to 0.35%, and Mn: 0.20 to 1.50% and a balance of substantially Fe and unavoidable impurities by a rolling reduction of 20% or more and 85% or less, then using a bell type batch annealing furnace with a gas atmosphere comprised of 75 vol % or more of hydrogen and a balance of substantially nitrogen and unavoidable impurities to perform annealing treatment repeatedly heating the strip by a 20 to 100° C./h heating rate to the Ac1 point to Ac1 point+50° C. for soaking and heating for 8 hours or less and cooling by a 50° C./h or less cooling rate down to the Ar1 point or less to thereby inexpensively produce high carbon cold rolled steel strip which prevents formation of seizure flaws, is softened, and is excellent in workability.

PTL 2 discloses a steel sheet for working use excellent in clarity of a coating image characterized by forming the steel sheet surface into a rough surface, making the wavelength λ of the pattern of roughness on the rough surface 500 μm or less, and making a centerline average roughness Ra a range of 1 to 5 μm.

PTL 3 discloses a steel sheet having a predetermined chemical composition, having a metal microstructure containing, by area ratio, polygonal ferrite in 40.0% or more and less than 60.0%, bainitic ferrite in 30.0% or more, retained austenite in 10.0% or more and 25.0% or less, and martensite in 15.0% or less, having a ratio, in the retained austenite, of retained austenite with an aspect ratio of 2.0 or less, a length of a long axis of 1.0 μm or less, and a length of a short axis of 1.0 μm or less of 80.0% or more, having a ratio, in the bainitic ferrite, of bainitic ferrite with an aspect ratio of 1.7 or less and an average value of a crystal orientation difference of a region surrounded by grain boundaries with a crystal orientation difference of 15° or more of 0.5° or more and less than 3.0° of 80.0% or more, and having a connectivity D value of the martensite, the bainitic ferrite, and the retained austenite of 0.70 or less.

CITATIONS LIST

Patent Literature

PTL 1. Japanese Unexamined Patent Publication No. H10-204540

PTL 2. Japanese Unexamined Patent Publication No. H4-253503

PTL 3. Japanese Patent No. 6791838

SUMMARY

Technical Problem

The present application, in view of the situation, discloses steel sheet excellent in energy absorption at the time of crushing deformation and a method of production of the same.

Solution to Problem

The inventors intensively studied a solution to the above problem and clarified that by increasing the surface roughness of a steel sheet to introduce starting points for deformation at the surface of the steel sheet, the steel sheet exhibiting excellent energy absorption in crushing deformation is obtained. Together with this, in the steel sheet with a smooth surface, they also confirmed that the deformation becomes localized at the time of crushing and the absorbed energy incidentally falls.

Further, the inventors discovered that it is possible to produce the above steel sheet by an integrated production process characterized by modifying the hot rolling conditions to raise the roughness on the surface of the hot rolled steel sheet and proceeding through the annealing step without completely flattening the roughness.

Further, the inventors discovered through repeated diverse research that steel sheet having such surface roughness and thereby raising the absorption energy during crushing deformation is difficult to produce if just modifying the hot rolling conditions, annealing conditions, etc. singly and that production is only possible by optimization of the hot rolling and annealing steps and other steps in the so-called integrated process.

The gist of the present invention is as follows:

(1) A steel sheet having a chemical composition containing, by mass %,

C: 0.05 to less than 0.15%,
Si: 0.01 to 2.00%,
Mn: 0.10 to 4.00%,
P: 0.0200% or less,
S: 0.0200% or less,
Al: 0.001 to 1.000%,
N: 0.0200% or less,
Ti: 0 to 0.500%,
Co: 0 to 0.500%,
Ni: 0 to 0.500%,
Mo: 0 to 0.500%,
Cr: 0 to 2.000%,
O: 0 to 0.0100%,
B: 0 to 0.0100%,
Nb: 0 to 0.500%,
V: 0 to 0.500%,
Cu: 0 to 0.500%, W: 0 to 0.1000%,
Ta: 0 to 0.1000%,
Sn: 0 to 0.0500%,
Sb: 0 to 0.0500%,
As: 0 to 0.0500%,
Mg: 0 to 0.0500%,
Ca: 0 to 0.0500%,
Y: 0 to 0.0500%,
Zr: 0 to 0.0500%,
La: 0 to 0.0500%,
Ce: 0 to 0.0500% and
a balance of Fe and impurities,
having a microstructure comprised of, by area ratio,
a total of ferrite, pearlite, and bainite: 0% or more and 60.0% or less,
retained austenite: 0% or more and 1.0% or less, and
a balance of martensite and tempered martensite, and
having on the sheet surface a plurality of step differences having height differences of more than 5.0 μm at intervals of 2.0 mm or less.

(2) The steel sheet according to (1), having the chemical composition containing, by mass %, one or more of
Ti: 0.001 to 0.500%,
Co: 0.001 to 0.500%,
Ni: 0.001 to 0.500%,
Mo: 0.001 to 0.500%,
Cr: 0.001 to 2.000%
O: 0.0001 to 0.0100%
B: 0.0001 to 0.0100%,
Nb: 0.001 to 0.500%,
V: 0.001 to 0.500%,
Cu: 0.001 to 0.500%,
W: 0.0001 to 0.1000%,
Ta: 0.0001 to 0.1000%,
Sn: 0.0001 to 0.0500%,
Sb: 0.0001 to 0.0500%,
As: 0.0001 to 0.0500%,
Mg: 0.0001 to 0.0500%,
Ca: 0.0001 to 0.0500%,
Y: 0.0001 to 0.0500%,
Zr: 0.0001 to 0.0500%,
La: 0.0001 to 0.0500%, and
Ce: 0.0001 to 0.0500%.

(3) A method of production of a steel sheet,
the method comprising:
hot rolling a steel slab having a chemical composition according to the above (1) or (2) to obtain a hot rolled steel sheet,
coiling the hot rolled steel sheet,
pickling the hot rolled steel sheet, and
annealing the hot rolled steel sheet without cold rolling or annealing it after cold rolling,
wherein the hot rolling includes supplying a lubricant between a rolling roll and sheet while rolling the sheet by a rolling reduction of more than 30% and 70% or less at one stand before a final stand of a finishing mill,
a temperature when coiling the hot rolled steel sheet is 700° C. or less, and
when performing cold rolling, a rolling reduction in the cold rolling is 0.1 to 20%.

(4) The method of production according to the above (3), further comprising, in the annealing, forming coated layers comprised of zinc, aluminum, magnesium, or alloys of the same on the front and back surfaces of the sheet.

Effects of Invention

According to the present invention, it is possible to provide steel sheet excellent in energy absorption at the time of crushing deformation and a method of production of the same.

DESCRIPTION OF EMBODIMENTS

Figure 1:
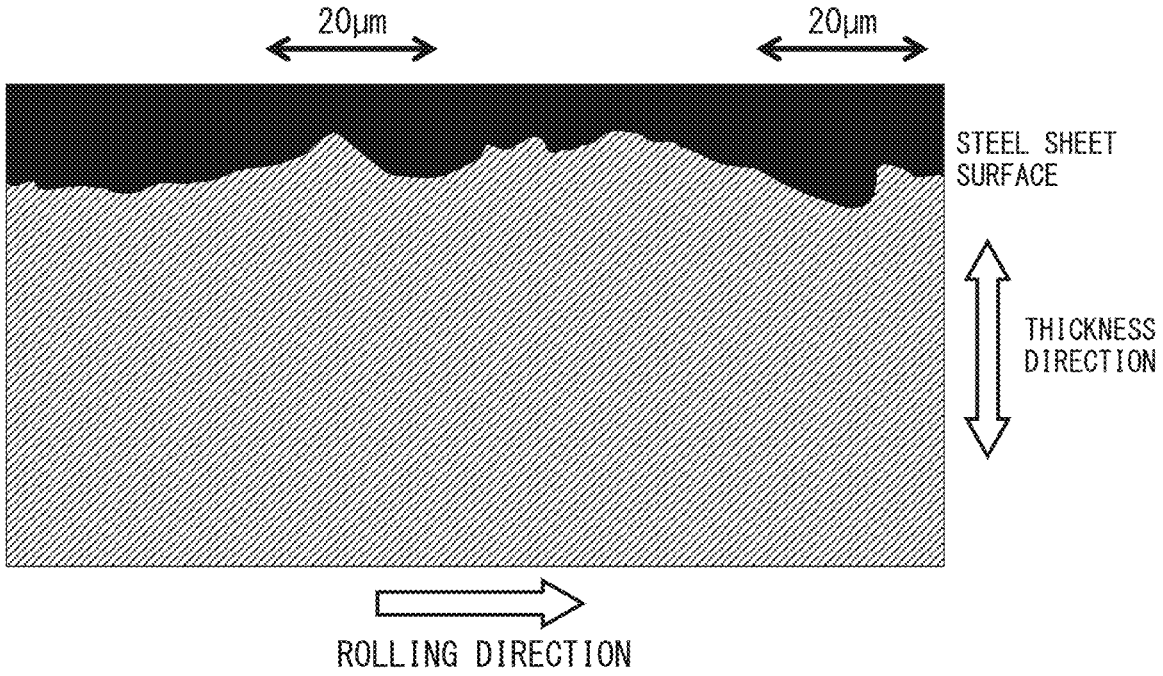
FIG. 1 schematically shows the form of step differences at the surface of a steel sheet.

Below, embodiments of the present invention will be explained. Note that the explanations of these are intended as simple illustrations of the embodiments of the present invention. The present invention is not limited to the following embodiments.

<Steel Sheet>

The steel sheet according to the present embodiment has a chemical composition containing, by mass %,
C: 0.05 to less than 0.15%,
Si: 0.01 to 2.00%,
Mn: 0.10 to 4.00%,
P: 0.0200% or less,
S: 0.0200% or less,
Al: 0.001 to 1.000%,
N: 0.0200% or less,
Ti: 0 to 0.500%,
Co: 0 to 0.500%,
Ni: 0 to 0.500%,
Mo: 0 to 0.500%,
Cr: 0 to 2.000%,
O: 0 to 0.0100%,
B: 0 to 0.0100%,
Nb: 0 to 0.500%,
V: 0 to 0.500%,
Cu: 0 to 0.500%,
W: 0 to 0.1000%,
Ta: 0 to 0.1000%,
Sn: 0 to 0.0500%,
Sb: 0 to 0.0500%,
As: 0 to 0.0500%,
Mg: 0 to 0.0500%,
Ca: 0 to 0.0500%,
Y: 0 to 0.0500%,
Zr: 0 to 0.0500%,
La: 0 to 0.0500%,
Ce: 0 to 0.0500% and
a balance of Fe and impurities,
has a microstructure comprised of, by area ratio,
a total of ferrite, pearlite, and bainite: 0% or more and 60.0% or less,
retained austenite: 0% or more and 1.0% or less, and
a balance of martensite and tempered martensite, and
has on the sheet surface a plurality of step differences having height differences of more than 5.0 μm at intervals of 2.0 mm or less.

First, the reasons for limiting the chemical composition of the steel sheet according to the present embodiment will be explained. Here, the "%" regarding the constituents means mass %. Furthermore, in this Description, the "to" showing a numerical range, unless otherwise indicated, is used in the sense including the numerical values described before and after it as a lower limit value and upper limit value.

(C: 0.05 to Less Than 0.15%)

C is an element for inexpensively making the tensile strength increase and is an extremely important element for inhibiting transformation from austenite to ferrite, bainite, and pearlite in a continuous annealing step and controlling the strength of steel. If the C content is 0.05% or more, such an effect is easily obtained. The C content may be 0.07% or more. On the other hand, if excessively containing C, due to the increase in area ratio of the retained austenite, work inducted transformation occurs in a small amount of deformation at the time of crushing deformation, so the absorbed energy may decrease. If the C content is 0.15% or less, such a problem is easily avoided. The C content may be 0.13% or less.

(Si: 0.01 to 2.00%)

Si is an element which acts as a deoxidizer and inhibits precipitation of carbides in the cooling process during cold rolling and annealing. If the Si content is 0.01% or more, such an effect is easily obtained. The Si content may be 0.10% or more. On the other hand, if excessively containing Si, the workability is deteriorated along with an increase in steel strength, coarse oxides are scattered at the surface layer of the hot rolled steel sheet, and it is difficult to obtain the desired roughness at the surface of the steel sheet after cold rolling and annealing, so absorption energy at the time of crushing deformation may decrease. If the Si content is 2.00% or less, such a problem is easily avoided. The Si content may be 1.60% or less.

(Mn: 0.10 to 4.00%)

Mn is a factor affecting the ferrite transformation of steel and an element effective for raising the strength. If the Mn content is 0.10% or more, such an effect is easily obtained. The Mn content may also be 0.60% or more. On the other hand, if excessively containing Mn, the workability is deteriorated along with an increase in steel strength, coarse oxides are scattered at the surface layer of the hot rolled steel sheet, and it is difficult to obtain the desired roughness at the surface of the steel sheet after cold rolling and annealing, so the absorption energy at the time of crushing deformation may decrease. If the Mn content is 4.00% or less, such a problem is easily avoided. The Mn content may be 3.00% or less.

(P: 0.0200% or Less)

P is an element for promoting concentration of Mn at unsolidified parts in the process of solidification of molten steel and an element which lowers the Mn concentration at the negative segregated parts and promotes an increase in the area ratio of ferrite. The less the better. Further, excessively containing P causes brittle fracture of the steel along with an increase in the steel strength and the absorption energy at the time of crushing deformation may decrease. The P content may be 0%, may be 0.0001% or more, or may be 0.0010% or more, and may be 0.0200% or less, or may be 0.0180% or less.

(S: 0.0200% or Less)

S is an element forming MnS and other nonmetallic inclusions in the steel and causing a decrease in ductility of a steel part. The less the better. Further, excessively containing S causes fractures starting from nonmetallic inclusions at the time of crushing deformation and it is difficult to obtain the desired roughness at the surface of the steel sheet after cold rolling and annealing, so the absorption energy at the time of crushing deformation may decrease. The S content may be 0%, may be 0.0001% or more, or may be 0.0005% or more, and may be 0.0200% or less, or may be 0.0180% or less.

(Al: 0.001 to 1.000%)

Al is an element acting as a deoxidizer of steel and stabilizing ferrite and is added in accordance with need. If the Al content is 0.0010% or more, such an effect is easily obtained. The Al content may be 0.010% or more. On the other hand, if excessively containing Al, ferrite transformation and bainite transformation in the cooling process are excessively promoted in the annealing and the strength of the steel sheet may decrease. Further, if excessively containing Al, in the middle of hot rolling, large amounts of coarse Al oxides are formed on the steel sheet surface, the desired roughness is liable to be difficult to obtain on the steel sheet surface, and the absorption energy at the time of crushing deformation may decrease. If the Al content is 1.000% or less, such a problem is easily avoided. The Al content may be 0.800% or less.

(N: 0.0200% or Less)

N is an element forming coarse nitrides in the steel sheet and causing deterioration in the workability of the steel sheet. Further, N is an element causing of formation of blowholes at the time of welding. Further, if excessively containing N, it bonds with Al and Ti to form large amounts of AlN and TiN. These nitrides suppress contact between the steel sheet surface and roll during the hot rolling, so it is difficult to obtain the desired roughness at the surface of the steel sheet after the cold rolling and annealing and the absorption energy at the time of crushing deformation may decrease. The N content may be 0%, may be 0.0001% or more, or may be 0.0010% or more, and may be 0.0200% or less, or may be 0.0160% or less.

The basic chemical composition of the steel sheet in the present embodiment is as explained above. Furthermore, the steel sheet in the present embodiment may include at least one type of the following optional elements. These elements need not be included, so the lower limit is 0%.

(Ti: 0 to 0.500%)

Ti is a strengthening element. It contributes to increase strength of the steel sheet by precipitation strengthening, fine grain strengthening by suppression of growth of crystal grains, and dislocation strengthening through suppression of recrystallization. On the other hand, if excessively containing Ti, the precipitation of coarse carbides becomes greater and these carbides are kept from contacting the steel sheet surface and roll during hot rolling, so it is difficult to obtain the desired roughness at the surface of the steel sheet after the cold rolling and annealing and the absorption energy at the time of crushing deformation may decrease. The Ti content may be 0%, may be 0.001% or more, or may be 0.005% or more, and may be 0.500% or less, or may be 0.400% or less.

(Co: 0 to 0.500%)

Co is an element effective for controlling the form of the carbides and increasing the strength and is added in accordance with need for controlling the strength. On the other hand, if excessively containing Co, a large number of fine Co carbides precipitate and these carbides suppress contact between the steel sheet surface and roll during hot rolling, whereby it is difficult to obtain the desired roughness at the surface of the steel sheet after cold rolling and annealing, and the absorption energy at the time of crushing deformation may decrease. The Co content may be 0%, or may be 0.001% or more, and may be 0.500% or less, or may be 0.400% or less.

(Ni: 0 to 0.500%)

Ni is a strengthening element and is effective for improvement of the hardenability. In addition, it may be added since it causes improvement of the wettability of the steel sheet and plating and promotion of an alloying reaction. On the other hand, if excessively containing Ni, it affects the removability of oxide scale at the time of hot rolling, scratches are promoted at the steel sheet surface, it is difficult to obtain the desired roughness at the surface of the steel sheet after cold rolling and annealing, and the absorption energy at the time of crushing deformation may decrease. The Ni content may be 0%, or may be 0.0010% or more, and may be 0.500% or less, or may be 0.400% or less.

(Mo: 0 to 0.500%)

Mo is an element effective for improvement of the strength of steel sheet. Further, Mo is an element having the effect of inhibiting ferrite transformation occurring at the time of heat treatment at a continuous annealing facility or a continuous hot dip galvanization facility. On the other hand, if excessively containing Mo, a large number of fine Mo carbides precipitate. These carbides inhibit contact between the steel sheet surface and roll during hot rolling, so it is difficult to obtain the desired roughness at the surface of the steel sheet after cold rolling and annealing and the absorption energy at the time of crushing deformation may decrease. The Mo content may be 0%, or may be 0.001% or more, and may be 0.500% or less, or may be 0.400% or less.

(Cr: 0 to 2.000%)

As well as Mn, Cr is an element suppressing pearlite transformation and effective for increasing the strength of steel. It is added in accordance with need. On the other hand, if excessively containing Cr, formation of retained austenite is promoted and due to the presence of excessive retained austenite, the starting points of fracture at the time of crushing deformation increase and the absorption energy at the time of crushing deformation may decrease. The Cr content may be 0%, or may be 0.001% or more, and may be 2.000% or less, or may be 1.500% or less.

(O: 0 to 0.0100%)

O forms oxides and causes deterioration of the workability, so the O content has to be suppressed. In particular, oxides are often present as inclusions and granular coarse oxides present on the steel sheet surface causes fracture of the steel sheet surface and formation of fine iron powder during hot rolling and it is difficult to obtain the desired roughness at the surface of the steel sheet after cold rolling and annealing, and the absorption energy at the time of crushing deformation may decrease. The O content may be 0.0100% or less or may be 0.0080% or less. Further, the O content may be 0%, but controlling the O content to less than 0.0001% is liable to increase the refining time and also an increase the production costs. From the aim of preventing a rise in the production costs, the O content may be 0.00010% or more or may be 0.0010% or more.

(B: 0 to 0.0100%)

B is an element keeping down the formation of ferrite and pearlite and promoting the formation of bainite, martensite, or other low temperature transformed structures from austenite in the cooling process. Further, B is an element advantageous for increasing the strength of steel and is added in accordance with need. On the other hand, excessively containing B causes formation of coarse B oxides in the steel. B oxides keep down contact between the steel sheet surface and roll during hot rolling, so it is difficult to obtain the desired roughness at the surface of the steel sheet after cold rolling and annealing and the absorption energy at the time of crushing deformation may decrease. The B content may be 0%, may be 0.0001% or more, or may be 0.0010% or more, and may be 0.0100% or less, or may be 0.0080% or less.

(Nb: 0 to 0.500%)

Nb is an element effective for control of the form of carbides. It is an element also effective for improvement of toughness since it refines the structures due to its addition. On the other hand, if excessively containing Nb, a large number of fine hard Nb carbides precipitate. These carbides keep down contact between the steel sheet and roll during hot rolling, so it is difficult to obtain the desired roughness at the surface of the steel sheet after cold rolling and annealing, and the absorption energy at the time of crushing deformation may decrease. The Nb content may be 0%, or may be 0.001% or more, and may be 0.500% or less, or may be 0.400% or less.

(V: 0 to 0.500%)

V is a strengthening element. It contributes to increase strength of steel sheet through precipitation strengthening, fine grain strengthening by suppression of growth of ferrite crystals, and dislocation strengthening through suppression of recrystallization. On the other hand, if excessively containing V, a greater amount of carbonitrides precipitate. These carbonitrides suppress contact between the steel sheet surface and roll during hot rolling, so it is difficult to obtain the desired roughness at the surface of the steel sheet after cold rolling and annealing, and the absorption energy at the time of crushing deformation may decrease. The V content may be 0%, or may be 0.001% or more, and may be 0.500% or less, or may be 0.400% or less.

(Cu: 0 to 0.500%)

Cu is effective for raising the strength of steel sheet. On the other hand, if excessively containing Cu, during hot rolling, the steel material becomes brittle and hot rolling becomes impossible. Further, due to the Cu layer concentrated at the steel sheet surface, contact between the steel sheet surface and roll during the hot rolling is suppressed, so it is difficult to obtain the desired roughness at the surface of the steel sheet after cold rolling and annealing and the absorption energy at the time of crushing deformation may decrease. The Cu content may be 0%, or may be 0.001% or more, and may be 0.500% or less, or may be 0.400% or less.

(W: 0 to 0.1000% or Less)

W is effective for raising the strength of steel sheet. On top of this, precipitates and crystallized substances containing W become hydrogen trapping sites. On the other hand, if excessively containing W, coarse carbides are formed and the carbides suppress contact between the steel sheet surface and roll during the hot rolling, so it is difficult to obtain the desired roughness at the surface of the steel sheet after cold rolling and annealing and the absorption energy at the time of crushing deformation may decrease. The W content may be 0%, may be 0.00010% or more, or may be 0.0010% or more, and may be 0.1000% or less, or may be 0.0800% or less.

(Ta: 0 to 0.1000%)

As well as Nb, V, and W, Ta is an element effective for controlling the form of the carbides and increasing the strength and is added in accordance with need. On the other hand, if excessively containing Ta, a large number of fine Ta carbides precipitate and these carbides suppress contact between the steel sheet surface and roll during hot rolling, so it is difficult to obtain the desired roughness at the surface of the steel sheet after cold rolling and annealing and the absorption energy at the time of crushing deformation may decrease. The Ta content may be 0%, may be 0.0001% or more, or may be 0.0010% or more, and may be 0.1000% or less, or may be 0.0800% or less.

(Sn: 0 to 0.0500%)

Sn is an element contained in steel when using scrap as a material. The less the better. Excessively containing Sn causes fracture of the steel sheet surface and formation of fine iron powder during hot rolling, whereby it is difficult to obtain the desired roughness at the surface of the steel sheet after cold rolling and annealing, and the absorption energy at the time of crushing deformation may decrease. The Sn content may be 0.0500% or less, or may be 0.0400% or less. Further, the Sn content may be 0%, but controlling the Sn content to less than 0.0001% is liable to invite an increase in the refining time and also an increase the production costs. From the aim of preventing a rise in the production costs, the Sn content may be 0.00010% or more, or may be 0.0010% or more.

(Sb: 0 to 0.0500%)

As well as Sn, Sb is an element contained if using scrap as a steel raw material. Sb strongly segregates at the grain boundaries and causes embrittlement of the grain boundaries and deterioration in the ductility, so the less the better. Further, excessively containing Sb causes fracture of the steel sheet surface and formation of fine iron powder during hot rolling, whereby it is difficult to obtain the desired roughness at the surface of the steel sheet after cold rolling and annealing, and the absorption energy at the time of crushing deformation may decrease. The Sb content may be 0.0500% or less, or may be 0.0400% or less. Further, the Sb content may be 0%, but controlling the Sb content to less than 0.0001% is liable to invite an increase in the refining time and also an increase the production costs. From the aim of preventing a rise in the production costs, the Sb content may be 0.00010% or more, or may be 0.0010% or more.

(As: 0 to 0.0500%)

As well as Sn and Sb, As is an element contained if using scrap as a steel raw material and strongly segregates at the grain boundaries. The less the better. Further, excessively containing As causes fracture of the steel sheet surface and formation of fine iron powder during hot rolling, whereby it is difficult to obtain the desired roughness at the surface of the steel sheet after cold rolling and annealing, and the absorption energy at the time of crushing deformation may decrease. The As content may be 0.0500% or less, or may be 0.0400% or less. Further, the As content may be 0%, but controlling the As content to less than 0.0001% is liable to invite an increase in the refining time and also an increase the production costs. From the aim of preventing a rise in the production costs, the Ab content may be 0.00010% or more, or may be 0.0010% or more.

(Mg: 0 to 0.0500%)

Mg is an element able to control the form of sulfides if added in trace amounts and is added according to need. On the other hand, if excessively containing Mg, coarse inclusions are formed and the inclusions suppress contact between the steel sheet surface and roll during hot rolling, so it is difficult to obtain the desired roughness at the surface of the steel sheet after cold rolling and annealing and the absorption energy at the time of crushing deformation may decrease. The Mg content may be 0%, may be 0.00010% or more, or may be 0.0010% or more, and may be 0.0500% or less, or may be 0.0400% or less.

(Ca: 0 to 0.0500%)

Ca is useful as a deoxidizing element and also exhibits the effect of control of the form of the sulfides. On the other hand, excessively containing Ca causes fractures of the steel sheet surface and formation of fine iron powder during hot rolling, whereby it is difficult to obtain the desired roughness at the surface of the steel sheet after cold rolling and annealing, and the absorption energy at the time of crushing deformation may decrease. The Ca content may be 0%, may be 0.0001% or more, or may be 0.0010% or more, and may be 0.0500% or less, or may be 0.0400% or less.

(Y: 0 to 0.0500%)

As well as Mg and Ca, Y is an element able to control the form of the sulfides by addition in a trace amount and is added according to need. On the other hand, if excessively containing Y, coarse Y oxides are formed. The Y oxides suppress contact between the steel sheet surface and roll during hot rolling, so it is difficult to obtain the desired roughness at the surface of the steel sheet after cold rolling and annealing and the absorption energy at the time of crushing deformation may decrease. The Y content may be 0%, may be 0.0001% or more, or may be 0.0010% or more, and may be 0.0500% or less, or may be 0.0400% or less.

(Zr: 0 to 0.0500%)

As well as Mg, Ca, and Y, Zr is an element able to control the form of the sulfides by addition in a trace amount and is added according to need. On the other hand, if excessively containing Zr, coarse Zr oxides are formed. The Zr oxides suppress contact between the steel sheet surface and roll during hot rolling, so it is difficult to obtain the desired roughness at the surface of the steel sheet after cold rolling and annealing and the absorption energy at the time of crushing deformation may decrase. The Zr content may be 0%, may be 0.0001% or more, or may be 0.0010% or more, and may be 0.0500% or less, or may be 0.0400% or less.

(La: 0 to 0.0500%)

La is an element effective for control of the form of the sulfides by addition in a trace amount and is added according to need. On the other hand, if excessively containing La, La oxides are formed. The La oxides suppress contact between the steel sheet surface and roll during hot rolling, so it is difficult to obtain the desired roughness at the surface of the steel sheet after cold rolling and annealing and the absorption energy at the time of crushing deformation may decrease. The La content may be 0%, may be 0.0001% or more, or may be 0.0010% or more, and may be 0.0500% or less, or may be 0.0400% or less.

(Ce: 0 to 0.0500%)

As well as La, Ce is an element effective for control of the form of the sulfides by addition in a trace amount and is added according to need. On the other hand, if excessively containing Ce, Ce oxides are formed. The Ce oxides suppress contact between the steel sheet surface and roll during hot rolling, so it is difficult to obtain the desired roughness at the surface of the steel sheet after cold rolling and annealing and the absorption energy at the time of crushing deformation may decrease. The Ce content may be 0%, may be 0.0001% or more, or may be 0.0010% or more, and may be 0.0500% or less, or may be 0.0400% or less.

In the steel sheet in the present embodiment, the balance of the constituents explained above is Fe and impurities. The "impurities" are constituents entering due to various factors in the production process etc., starting with ore, scrap, and other such materials, when industrially producing the steel sheet according to the present embodiment.

Next, the features of the steel microstructure and characteristics of the steel sheet according to the present embodiment will be explained.

(Total of Area Ratios of Ferrite, Pearlite, and Bainite:0 to 60.0%) Ferrite, pearlite, and bainite are effective for improvement of the strength-ductility balance of steel sheet, but if including large amounts, the local ductility is deteriorated and the absorption energy at the time of crushing deformation decreases. Further, from the viewpoint of efficiently raising the strength of steel, the smaller the area ratios of ferrite, pearlite, and bainite, the better. The total of the area ratios of ferrite, pearlite, and bainite may be 0%, or may be 1.0% or more, and may be 60.0% or less, may be 55.0% or less, or may be 50.0% or less. Further, while the productivity falls, by controlling the integrated production conditions by a high precision, it becomes possible to make the total of the area ratios of ferrite, pearlite, and bainite 0%.

(Area Ratio of Retained Austenite: 0% to 1.0%)

Retained austenite is effective for improvement of the strength-ductility balance of steel sheet. On the other hand, if the area ratio of the retained austenite is too large, the ratio of the chemically unstable austenite increases and work induced transformation occurs in a small amount of deformation at the time of crushing deformation, so the absorption energy may decrease. The area ratio of retained austenite may be 0%, or may be 1.0% or more, and may be 1.0% or less, and may be 0.8% or less.

(Balance: Martensite and Tempered Martensite)

Martensite and tempered martensite are extremely effective for improvement of the strength of steel sheet. The higher the area ratios, the better. For example the balance other than the above structures may be martensite and tempered martensite. The total of the area ratios of martensite and tempered martensite may be 30.0% or more, may be 35.0% or more, may be 40.0% or more, may be 45.0% or more, or may be 50.0% or more, and may be 100%, or may be 99.0% or less. Further, while the productivity falls, by controlling the integrated production conditions by a high precision, it becomes possible to make the total of the area ratios of martensite and tempered martensite 100%.

(Surface Roughness)

At the steel sheet surface, the interval of step differences with a height difference of more than 5.0 μm is an important factor functioning as a starting point for bending deformation of steel sheet when receiving crushing deformation. The shorter the interval, the better. Specifically, in the surface of the steel sheet according to the present embodiment, it is important that there be multiple step differences with a height difference of more than 5.0 μm at intervals of 2.0 mm or less. The interval may be 1.8 mm or less, may be 1.5 mm or less, may be 1.2 mm or less, may be 1.0 mm or less, may be 0.7 mm or less, or may be 0.4 mm or less. Further, if the interval is less than 0.01 mm, the steel sheet surface may become a sawtooth shape. On this point, the interval may be 0.01 mm or more, or may be 0.05 mm or more. Further, in the steel sheet according to the present embodiment, a plurality of step differences with a height difference of more than 5.0 μm have to be present dispersed at the above intervals at the steel sheet surface. In particular, if there are a plurality of step differences with a height difference of 7.0 μm or more or 10.0 μm or more present dispersed at the above intervals at the steel sheet surface, the steel sheet becomes much better in energy absorption at the time of crushing deformation. The upper limit of the height difference of the step differences is not particularly limited, but for example may be 20.0 μm or less, 15.0 μm or less, or 10.0 μm or less. In the steel sheet according to the present embodiment, there may be a plurality of step differences with a height difference of more than 5.0 μm present dispersed at 2.0 mm or less intervals at 50 area % or more, 60 area % or more, 70 area % or more, 80 area % or more, or 90 area % or more of the steel sheet surface.

FIG. 1 shows one example of "step differences with height differences of more than 5.0 μm". FIG. 1 shows the form of the step differences in the case of examining steel sheet in a cross-section in the thickness direction. As shown in FIG. 1, roughnesses may be repeatedly formed at the steel sheet surface in the rolling direction. The height differences of the step differences identified by the individual roughnesses are more than 5.0 μm. A plurality of the step differences are included in a range of within 2.0 mm, that is, the interval of the step differences becomes 2.0 mm or less. In the present invention, at least one of the step differences in the plurality of step differences may have so-called "negative angle parts" (undercut parts). Further, in the present invention, the heights of the plurality of step differences may differ from each other. For example, the respective heights may be different irregularly (randomly). Further, the shapes of the plurality of step differences may also differ from each other. Further, the intervals of the plurality of step differences may not be constant and may be irregularly (randomly) differ. Such shapes of step differences can be formed by the following method.

Figure 2A:
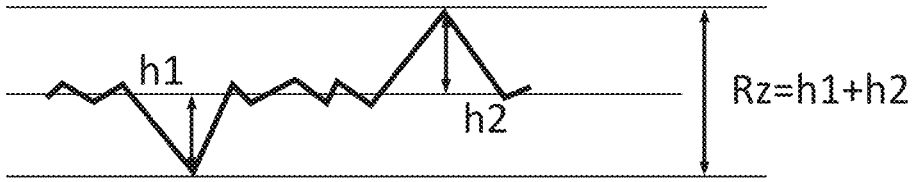
FIG. 2 is a schematic view for explaining a difference between a "maximum height roughness Rz" and a "step difference" in the present application.
Figure 2B:
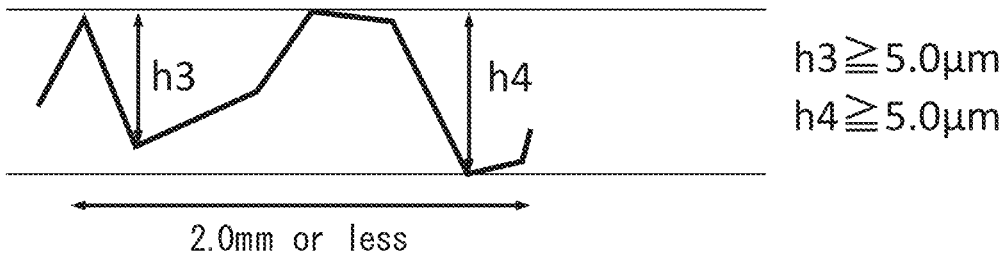

Further, the "step differences with height differences of more than 5.0 μm" referred to in the present application is a concept different from the general surface roughness such as the maximum height roughness Rz or arithmetic average roughness Ra. For example, the "maximum height roughness Rz", as shown in FIG. 2A, means the distance between the most projecting part and most recessed part in the surface roughness (maximum difference of height). Further, it is not possible to identify the distribution (intervals) of surface roughness from the "maximum height roughness Rz". Further, the "arithmetic average roughness Ra" is the average value of the surface roughness and the maximum value is unclear. Further, it is not possible to identify the distribution (intervals) of surface roughness from the "arithmetic average roughness Ra". As opposed to this, the "step differences with height differences of more than 5.0 μm" referred to in the present application, as shown in FIG. 2B, means the height difference of "one step difference" is more than 5.0 μm and there must be a plurality of step differences at intervals of 2.0 mm or less.

(Yield Strength)

To lighten the weight of a structure using steel as its material and improve the resistance when starting plastic deformation, the yield strength of the steel material is preferably high. On the other hand, if the yield strength is too high, the changes in shape due to elastic deformation after plastic forming and the effects of so-called springback become greater and the shapeability may be deteriorated. The yield strength of the steel sheet according to the present embodiment is not particularly limited, but may be 500 MPa or more, or may be 550 MPa or more, and may be 1100 MPa or less, or may be 1050 MPa or less.

(Tensile Strength)

To lighten the weight of a structure made using steel as its material and improve the resistance of the structure in plastic deformation, the steel material preferably has a large work hardening ability and exhibits the maximum strength. On the other hand, if the tensile strength is too large, fracture easily occurs by a low energy during plastic deformation and the formability may be deteriorated. The tensile strength of the steel sheet is not particularly limited, but may be 900 MPa or more, or may be 980 MPa or more, and may be 1470 MPa or less, may be 1410 MPa or less, may be 1350 MPa or less, or may be 1310 MPa or less.

(Total Elongation)

When cold forming a material of steel sheet to produce a structure, to finish it to a complicated shape, elongation is necessary. If the total elongation is too low, the material may fracture in the cold forming. On the other hand, the higher the total elongation, the better, but if excessively raising the total elongation, a large amount of retained austenite is necessary in the microstructure. Due to this, the absorption energy at the time of crushing deformation may decrease. The total elongation of the steel sheet is not particularly limited, but may be 5% or more, or may be 8% or more, and may be 20% or less, or may be 18% or less.

(Hole Expandability)

When cold forming a material of a steel sheet to produce a structure, to finish it to a complicated shape, hole expandability is also necessary along with elongation. If the hole expandability is too small, the material may fracture at the time of cold forming. The higher the hole expandability, the better, but if excessively raising the hole expandability, a large amount of retained austenite will become necessary in the steel microstructure and due to this, the absorption energy at the time of crushing deformation may decrease. The rate of hole expandability of steel sheet is not particularly limited, but may be 20% or more, or may be 25% or more, and may be 90% or less, and may be 80% or less.

(Bendability)

When cold forming a material of a steel sheet to produce a structure, bendability also becomes necessary to finish it to a complicated shape. As an indicator of the bendability, for example, there is the VDA bending angle $\alpha$ obtained by a test based on the provisions of Standard 238-100 of the Verband der Automobilindustrie (VDA). If the VDA bending angle is too small, the material may fracture at the time of cold forming. The higher the bendability, the better. The VDA bending angle of steel sheet is not particularly limited, but may be 45° or more, or may be 50° or more. Note that the VDA bending angle shown here is a characteristic value at a sheet thickness of 1.4 mm. With less than 1.4 mm sheet thickness, even with the same steel sheet, a high value of bending angle is obtained. Further, if the sheet thickness is more than 1.4 mm, it is preferable to use surface grinding to remove part of one surface of the sheet to finish the sheet to a thickness of 1.4 mm, then bend it with the ground surface as the inside of the bend and the nonground surface as the outside of the bend to thereby obtain a bending angle.

(Sheet Thickness)

The sheet thickness is a factor having an effect on the rigidity of the steel member after formation. The larger the sheet thickness, the higher the rigidity of the member. If the sheet thickness is too small, the rigidity is deteriorated and the press formability may be deteriorated due to the effect of the unavoidable nonferrous inclusions present inside the steel sheet. On the other hand, if the sheet thickness is too large, the press-forming load increases and wear of the die or a drop in the productivity is invited. The sheet thickness of the steel sheet is not particularly limited, but may be 0.2 mm or more and may be 6.0 mm or less. Further, the "steel sheet" referred to in the present application" may be a single-layer steel sheet. Here, the "single-layer steel sheet" means not a so-called double-layer steel sheet. If viewing a cross-section of the steel sheet, it means the joint interface of the base material steel sheets is not observed in the sheet thickness direction. For example, it is a steel sheet made from a single slab. The "sheet thickness" of the steel sheet may also be the sheet thickness as a single-layer steel sheet. Further, the single-layer steel sheet may also have a plating layer or other surface treatment layer formed on its surface. That is, the "steel sheet" referred to in the present application may also have a single-layer steel sheet and surface treatment layer.

Next, the methods of observation and measurement of structures prescribed above and the methods of measurement and evaluation of the characteristics prescribed above will be explained.

(Method of Measurement of Total of Area Ratios of Ferrite, Pearlite, and Bainite)

The microstructure is observed by a scan electron microscope (SEM). Before observation, a sample used for observation of the microstructure is polished by wet polishing by emery paper and by diamond abrasives having 1 μm average particle size, the surface to be observed is finished to a mirror surface, then the microstructure is etched by a 3% nitric acid alcohol solution. The observation is performed at a power of 3000×. Ten 30 μm×40 μm fields at positions of ¼ thickness from the surface side of the steel sheet are photographed at random. The ratios of the structures are found by the point count method. At the obtained images of the microstructure, a total of 100 lattice points is set arranged at intervals of vertical 3 μm and horizontal 4 μm. The structures present below the lattice points are discriminated and the ratios of structures contained in the steel material are found from the average of 10 samples. Ferrite comprises chunky crystal grains inside of which iron-based carbides with long axes of 100 nm or more are not contained. Bainite comprises assemblages of lath-shaped crystal grains inside of which iron-based carbides with long axes of 20 nm or more are not included or inside of which iron-based carbides with long axes of 20 nm or more are included and the carbides constitute a single variant, that is, belong to a group of iron-based carbides extending in the same direction. Here, the "group of iron-based carbides extending in the same direction" means the one having differences in direction of extension of the group of iron-based carbides of within 5°. As to bainite, bainite surrounded by grain boundaries with orientation differences of 15° or more is counted as a single bainite grain. Here, the "grain boundaries with orientation differences of 15° or more" are found by the following procedure using SEM-EBSD. For the measurement by SEM-EBSD, the surface to be observed of the measurement sample is finished to a mirror surface by polishing in advance, is cleared of distortions by polishing, then, in the same way as the above-mentioned observation by a SEM, 30 μm×40 μm fields at a thickness ¼ position from the surface side of the steel sheet are set for the measurement range and data on the crystal orientation of the B.C.C. iron is acquired by SEM-EBSD. The measurement by EBSD is performed using an EBSD detector attached to a SEM and the interval (step) of measurement is 0.05 μm. At this time, in the present invention, as the software for acquiring data on the crystal orientation, the software "OIM Data Collection™ (ver. 7)" made by K.K. TSL Solutions etc. is used. In the crystal orientation MAP data of the B.C.C. iron obtained under these measurement conditions, regions with a confidence index (CI value) of less than 0.1 are removed and boundaries with crystal orientation differences of 15° or more are identified as crystal grain boundaries. Further, bainite can be said to be a mixed structure of bainitic ferrite comprised of body-centric cubic structures of iron and iron-based carbides ($Fe_3C$). Bainitic ferrite is differentiated from the above-mentioned ferrite. Pearlite is a structure including cementite precipitated in lines. Regions captured by a bright contrast in a secondary electron image are deemed pearlite and the area ratio is calculated.

(Method of Discriminating Martensite and Tempered Martensite)

Regarding the martensite and tempered martensite, the structures are observed by scan type and transmission type electron microscopes. Structures containing Fe-based carbides inside are identified as being tempered martensite while structures not containing much carbides as a whole are identified as martensite. It has been reported Fe-based carbides having various crystalline structures, but any type of Fe-based carbides may be contained. Depending on the heat treatment conditions, several types of Fe-based carbides may be present. In the present application, the area ratio A1 of the total of ferrite, pearlite, and bainite is measured by the above method, the area ratio A2 of the retained austenite is measured by the method explained later, and the remainder after subtracting the total value of the area ratios A1 and A2 from 100% is deemed the area ratio of the total of the martensite and tempered martensite.

(Method of Measurement of Area Ratio of Retained Austenite)

The area ratio of retained austenite is determined in the following way by X-ray measurement. First, the part of a steel sheet from the surface to ¼ of the thickness of the steel sheet is removed by mechanical polishing and chemical polishing. The chemically polished surface was measured by using MoKα rays as the characteristic X-rays. Further, the following formula is used to calculate the area percent of the retained austenite at the sheet thickness center part from the integrated intensity ratio of the diffraction peaks of (200) and (211) of the body centered cubic lattice (bcc) phase and (200), (220), and (311) of the face centered cubic lattice (fcc) phase.

$$S\gamma=(I200f+I220f+I311f)/(I200b+I211b)\times 100$$

(where Sγ is the area fraction of retained austenite at the center part of sheet thickness, I200f, I220f, and I311f respectively show the intensities of diffraction peaks of (200), (220), and (311) of the fcc phase, and I200b and I211b respectively show the intensities of diffraction peaks of (200) and (211) of the bcc phase)

The sample used for X-ray diffraction may be reduced in thickness from the surface until a predetermined sheet thickness by mechanical polishing etc., then cleared of distortions by chemical polishing, electrolytic polishing, etc. and, simultaneously, the sample adjusted and measured by the above-mentioned method so that the sheet thickness becomes ⅛ to ⅜ in range and a suitable surface becomes the measurement surface. Naturally, the above-mentioned limitation of the X-ray intensity is preferably satisfied not only near ¼ sheet thickness, but for as much greater thickness as possible, whereby the anisotropy of the material quality becomes much smaller. However, by measurement at ⅛ to ⅜ from the surface of the steel sheet, it is possible to represent the material properties of the steel sheet as a whole. Therefore, ⅛ to ⅜ of the sheet thickness is made the measurement range.

(Method of Measurement of Intervals of Surface Roughness (Step Differences with Height Differences of More than 5.0 μm))

The height differences at the roughness at the steel sheet surface and the intervals of distribution are measured by a field emission scan electron microscope (FE-SEM). Before observation using a SEM, a sample to observe the microstructure with a length in the rolling direction of more than 20 mm is buried in a resin, then the surface parallel to the rolling direction and vertical to the sheet thickness direction (TD surface: transversal direction surface) is finished to a mirror surface by polishing. The observation power of the SEM is made 1000× and fields including both the steel sheet and resin in an observed range of a rolling direction of more than 110 μm and a sheet thickness direction of more than 70 μm is acquired over 20 mm in the rolling length direction to obtain consecutive photos including the roughness of the steel sheet surface. In the consecutive photos, locations where the height differences of roughness at the steel sheet surface exceed 5 μm within a range of a length of 20 μm in the rolling direction are defined as "step differences having height differences of more than 5.0 μm at the steel sheet surface" and the average of the intervals between one peak and another peak in a length of 20 mm in the rolling direction of the capturing range of the consecutive photos is defined as the "interval between step differences having height differences of more than 5.0 μm at the steel sheet surface". Further, in the present application, fine roughness with a height difference of not more than 1.0 μm will not be deemed as "step differences".

Further, even after the steel sheet is shaped and worked into some sort of member, it is possible to acquire part of the member after shaping and working (for example, a flat part) and analyze the surface conditions to thereby enable it to be judged if step differences with a height difference of more than 5.0 μm were present at intervals of 2.0 mm or less in a situation in which the member is steel sheet before shaping and working.

(Method of Measurement of Yield Strength, Tensile Strength, and Total Elongation)

The tensile test for measuring the yield strength, tensile strength, and total elongation is based on JIS Z 2241 and is performed by taking a JIS No. 5 test piece from an orientation where the longitudinal direction of the test piece becomes parallel to the direction perpendicular to rolling of the steel strip.

(Method of Measurement of Hole Expandability)

The hole expandability is evaluated by the hole expansion ratio λ (%) obtained by punching out a diameter 10 mm circular hole under conditions of a clearance of 12.5%, turning the burr to the die side, and expanding the hole by a 60° conical punch. Under these conditions, the hole expansion test is carried out five times and the average value of these is regarded as the hole expansion ratio.

<Method of Production of Steel Sheet>

The method of production of the steel sheet according to the present embodiment is characterized by using materials in the above ranges of constituents for integrated management of the hot rolling, cold rolling, and annealing. Specifically, the method of production of steel sheet according to the present embodiment is characterized by including the steps of hot rolling a steel slab having the same chemical composition as explained above relating to the steel sheet by a predetermined rolling reduction at one rolling machine before the final finish rolling machine while using a lubricant, coiling it, pickling the obtained hot rolled steel sheet, cold rolling it, then annealing it. More specifically, the method of production of the steel sheet according to the present embodiment is characterized by including hot rolling a steel slab having the above chemical composition to obtain a hot rolled steel sheet, coiling the hot rolled steel sheet, pickling the hot rolled steel sheet, and annealing the hot rolled steel sheet without cold rolling or annealing it after cold rolling, wherein the hot rolling includes supplying a lubricant between a rolling roll and the sheet while rolling the sheet by a rolling reduction of more than 30% and 70% or less at one stand before a final stand of a finishing mill, a temperature when coiling the hot rolled steel sheet is 700° C. or less, and when performing cold rolling, a rolling reduction in the cold rolling is 0.1 to 20%. Below, the steps will be explained in detail focusing on parts constituting points in the present embodiment.

(Rolling Reduction at One Stand Before Final Stand of Finishing Mill)

The rolling reduction at one stand before the final stand of the finishing mill is a factor having an effect on the surface conditions of the steel sheet. Here, by supplying a lubricant (for example, an aqueous solution in which a lubricant is mixed) to the surface of a rolled material (sheet) before rolling at one stand before the final stand and rolling while applying a high surface pressure in a state leaving the lubricant on the sheet surface, it is possible to intermittently apply partial sliding and partial contact between the sheet and roll surface during rolling to enhance the surface roughness of the sheet. If the rolling reduction is too small, the surface pressure between the sheet and roll at the time of rolling becomes insufficient and therefore it becomes no longer possible to form the desired surface roughness at the finally obtained steel sheet. Further, if the rolling reduction is too large, the surface pressure occurring between the sheet and roll during rolling becomes excessively high and the frequency of contact rises more than sliding between the sheet and roll, so it becomes difficult to impart the desired surface roughness to the finally obtained steel sheet. From the above viewpoint, in the present embodiment, the rolling reduction at the one stand before the final stand of the finishing mill in the hot rolling is more than 30% and 70% or less, preferably 35% or more and 60% or less. Further, at the final stand of the finishing mill, rolling by a large reduction ratio is difficult due to correction of the shape. The rolling reduction at the final stand of the finishing mill may be, for example, 20% or less.

Further, at the stand before the final stand, lubricant is supplied while rolling by a 30% or more rolling reduction so as to form step differences at the sheet surface, then control is performed so that the cumulative rolling reduction until the final stand becomes a light rolling reduction (for example, a cumulative 20% or less rolling reduction) so as to enable formation of the desired step differences at the surface of the hot rolled steel sheet after the finish rolling. On this point, the large rolling reduction for enhancing the surface roughness of the sheet may be performed at the stand at the upstream side from the one stand before the final stand. However, at the upstream side in the finish rolling, the sheet temperature is high and the shape of the surface of the sheet easily changes due to rolling. That is, after large rolling reduction, it is necessary to consider the effect of temperature while controlling the cumulative rolling reduction. On this point, supplying the lubricant at the downstream side in the finish rolling, in particular at one stand before the final stand, while performing large rolling reduction of 30% or more, then performing light rolling reduction at the final stand to adjust the sheet shape enables the desired step differences to be formed at the surface of the steel sheet.

As the lubricant, various ones can be used. For example, as the constituents of the lubricant, esters, mineral oils, polymers, fatty acids, S-based additives, and Ca-based additives may be contained. The viscosity of the lubricant may be 250 $mm^2/s$ or less. The lubricant, as explained above, may be used mixed with water. The amount of lubricant supplied is also not particularly limited, but for example may be one where 0.1 $g/m^2$ or more, or 1.0 $g/m^2$ or more, and 100.0 $g/m^2$ or less, or 50.0 $g/m^2$ or less of lubricant deposits on the steel sheet surface. The means for supplying the lubricant is not particularly limited, but, for example, the lubricant may also be supplied by spraying it on the sheet surface.

(Coiling Temperature)

The temperature at the time of coiling the hot rolled steel sheet (coiling temperature of hot rolled coil) is a factor controlling the state of formation of oxide scale on the hot rolled steel sheet and having an effect on the strength of the hot rolled steel sheet. To maintain the surface roughness formed by the hot rolling, the thickness of the scale formed on the hot rolled steel sheet surface should be kept thin. From this, the coiling temperature is preferably low. Further, if reducing the coiling temperature by an extreme amount, special facilities become necessary. Further, if the coiling temperature is too high, as explained above, the oxide scale formed on the surface of the hot rolled steel sheet becomes remarkably thick, so the projecting parts of the roughness formed at the surface of the hot rolled steel sheet due to the hot rolling are taken into the oxide scale. The scale is removed by the following pickling. As a result, the desired roughness become hard to form at the surface of the hot rolled steel sheet. From the above viewpoint, the temperature when coiling the hot rolled steel sheet is 700° C. or less, or may be 680° C. or less, and may be 0° C. or more, or may be 20° C. or more.

(Rolling Reduction in Cold Rolling)

The rolling reduction in cold rolling is an important factor for controlling the roughness on the steel sheet surface along with the shape of the hot rolled steel sheet. If performing cold rolling, if the rolling reduction is too small, shape defects of the hot rolled steel sheet cannot be corrected and curving of the steel strip is left, so the manufacturing ability in the following annealing step may be deteriorated and the absorption energy at the time of crushing deformation of a part formed into a square tube shape may decrease. On the other hand, if the rolling reduction in the cold rolling is too great, projecting parts of the roughness formed at the surface of the hot rolled steel sheet due to rolling are crushed by the cold rolling and it becomes difficult to obtain the desired surface roughness after the following annealing. From the above viewpoint, if performing cold rolling, the rolling reduction in the cold rolling is 0.1 to 20%. Preferably, it is 0.3% or more and 18.0% or less.

On the other hand, the hot rolled steel sheet may also be annealed as it is without cold rolling. In this case as well, the steel sheet having the desired surface roughness is easily finally obtained.

Below, a preferred embodiment of the method of production of steel sheet excellent in absorption energy at the time of crushing deformation will be explained in detail. The following description illustrates a preferred embodiment of the finishing temperature of hot rolling, heat treatment in annealing, plating treatment, etc. and does not in any way limit the method of production of steel sheet according to the present embodiment.

(Finish Rolling Temperature of Hot Rolling)

The finish rolling temperature of hot rolling is a factor having an effect on control of the texture by the former austenite grain size. From the viewpoint of development of the rolled texture of austenite and occurrence of anisotropy of steel material characteristics invited, the finish rolling temperature is preferably 650° C. or more. Further, from the aim of inhibiting unevenness in texture due to abnormal grain growth of austenite, the finish rolling temperature is desirably, for example, 940° C. or less.

(Annealing Atmosphere)

To prevent the easily oxidizable elements from dispersing to the steel sheet surface and promote internal oxidation, control of the oxygen potential in the heating zone at the time of annealing is important. Specifically, the annealing is preferably performed in an atmosphere containing 0.1 to 30 vol % of hydrogen and dew point −40 to 20° C. $H_2$ O and having a balance of nitrogen and impurities. More preferably, it is an atmosphere containing 0.5 to 20 vol % of hydrogen and dew point −30 to 15° C. $H_2O$, still more preferably an atmosphere containing 1 to 10 vol % of hydrogen and dew point −20 to 10° C. $H_2O$.

(Annealing Temperature)

If the maximum heating temperature at the time of annealing is too low, too much time will end up being taken for the carbides formed at the time of hot rolling to redissolve or part will remain and the martensite may not be sufficiently obtained after cooling, so the strength of the steel sheet will be difficult to secure. On the other hand, excessive high temperature heating will not only invite a rise in costs, but will also result in deterioration of the sheet shape at the time of high temperature sheet running or a drop in the lifetime of the rolls or otherwise cause trouble. From the above viewpoint, the maximum heating temperature (annealing holding temperature) at the time of annealing is preferably 750° C. or more and is preferably 900° C. or less.

(Annealing Holding Time)

At the time of annealing, the steel sheet is preferably held for 5 seconds or more at the above heating temperature. If the holding time is too short, the austenite transformation of the base material steel sheet does not sufficiently progress and the strength may be remarkably deteriorated. Further, recrystallization of the ferrite structure becomes insufficient and the variations in hardness become greater. From these viewpoints, the holding time is more preferably 10 seconds or more. More preferably, it is 20 seconds or more.

(Cooling Rate After Annealing)

In the cooling after annealing, the cooling is preferably performed from 750° C. to 550° C. or less by an average cooling rate of 100° C./s or less. The lower limit value of the average cooling rate is not particularly prescribed, but for example may be 2.5° C./s. The reason for making the lower limit value of the average cooling rate 2.5° C./s is to keep ferrite transformation from occurring at the base material steel sheet and the base material steel sheet from softening. If the average cooling rate is too slow, the strength easily falls. More preferably, it is 5° C./s or more, still more preferably 10° C./s or more, still more preferably 20° C./s or more. Further, if 750° C. or more, ferrite transformation becomes remarkably difficult to occur, so the cooling rate is not limited. Further, at a temperature of 550° C. or less, low temperature transformed structure are obtained, so the cooling rate is not limited. If the cooling rate is too fast, low temperature transformed structures are formed at the steel sheet surface as well and become factors behind variation of hardness. On this point, the average cooling rate is preferably 100° C./s or less, more preferably 50° C./s or less, still more preferably 20° C./s or less.

(Cooling Stop Temperature and Reheating After Annealing)

Further, after the above-mentioned cooling, the steel sheet may further be cooled to 25° C. to 550° C., then, if the cooling stop temperature is lower than the plating bath temperature, may be reheated to temperature region of 350° C. to 550° C. and made to dwell there. If cooling in the above temperature range, martensite is formed from the nontransformed austenite during the cooling. By reheating after that, the martensite is tempered, carbides precipitate inside the hard phases and dislocations are reversed and rearranged, and the hydrogen embrittlement resistance is improved. The lower limit of the cooling stop temperature was made 25° C. because excessive cooling not only necessitates massive capital investment, but also the effect becomes saturated.

(Dwell Temperature)

Furthermore, after reheating and before dipping in the plating bath, the steel sheet may be made to dwell at the temperature region of 350 to 550° C. The dwelling at this temperature region not only contributes to tempering of the martensite, but also eliminates temperature unevenness in the width direction of the sheet and improves the appearance after plating. Note that if the cooling stop temperature was 350° C. to 550° C., it is sufficient to perform dwelling without reheating.

(Dwell Time)

The time for the dwell operation is preferably 30 seconds or more and 300 seconds or less for obtaining its effects.

(Tempering)

In the series of annealing steps, the cold rolled sheet or the steel sheet obtained by plating the cold rolled sheet may be cooled down to room temperature or started to be reheated in the middle (however, Ms or less) of cooling it down to room temperature and may be held at a temperature range of 150° C. or more and 400° C. or less for 2 seconds or more. According to this step, it is possible to temper the martensite formed during the cooling after reheating to obtain tempered martensite and thereby improve the hydrogen embrittlement resistance. If performing the tempering step, if the holding temperature is too low and, further, if the holding time is too short, the martensite is not sufficiently tempered and there is almost no change in the microstructure and mechanical properties. On the other hand, if the holding temperature is too high, the dislocation density in the tempered martensite ends up falling and a drop in the tensile strength is invited. For this reason, if performing tempering, it is preferable to hold the steel sheet at a temperature range of 150° C. or more and 400° C. or less for 2 seconds or more. The tempering may be performed inside a continuous annealing facility or may be performed after continuous annealing off-line at another facility. At this time, the tempering time differs depending on the tempering temperature. That is, the lower the temperature, the longer the time and the higher the temperature, the shorter the time.

(Plating)

The steel sheet may, in accordance with need, be heated or cooled to the (galvanization bath temperature-40°) C to (galvanization bath temperature+50)° C. and hot dip galvanized. Due to the hot dip galvanization step, the surface of the steel sheet is formed with a hot dip galvanized layer. In this case, the corrosion resistance of the cold rolled steel sheet is improved, so this is preferable. For example, in the method of production according to the present embodiment, in the annealing, the front and back surfaces of the sheet may be formed with coated layers comprised of zinc, aluminum, magnesium, or their alloys. Alternatively, the front and back surfaces of the sheet after annealing may be formed with such coated layers.

(Steel Sheet Temperature After Dipping in Plating Bath)

If treating the hot dip galvanized layer for alloying, the steel sheet on which the hot dip galvanized layer is formed is heated to 450 to 550° C. in temperature range. If the alloying temperature is too low, the alloying is liable to not sufficiently proceed. On the other hand, if the alloying temperature is too high, the alloying will proceed too much and the F phase will be formed whereby the Fe concentration in the plating layer will exceed 15% and the corrosion resistance is liable to deteriorate. The alloying temperature is more preferably 470° C. or more and still more preferably is 540° C. or less. The alloying temperature has to be changed depending on the chemical composition of the steel sheet and the degree of formation of the internal oxidation layer, so should be set while confirming the Fe concentration in the plating layer.

(Composition of Plating Bath)

The plating bath is mainly comprised of Zn and preferably has an effective amount of Al (value of total amount of Al in plating bath minus total amount of Fe) of 0.050 to 0.250 mass %. If the effective amount of Al in the plating bath is too small, Fe will excessively enter into the plating layer and the plating adhesion is liable to fall. On the other hand, if the effective amount of Al in the plating bath is too large, Al-based oxides, which obstruct movement of Fe atoms and Zn atoms, will form at the boundary of the steel sheet and plating layer and the plating adhesion is liable to fall. The effective amount of Al in the plating bath is more preferably 0.065 mass % or more and more preferably 0.180 mass % or less.

(Steel Sheet Temperature at Time of Dipping in Plating Bath)

The temperature of the steel sheet when dipping it in the hot dip galvanization bath is preferably a temperature range of a temperature 40° C. lower than the hot dip galvanization bath temperature (hot dip galvanization bath temperature—40° C.) to a temperature 50° C. higher than the hot dip galvanization bath temperature (hot dip galvanization bath temperature—+50° C.). If the temperature is lower than the hot dip galvanization bath temperature—40° C., the heat removal at the time of dipping in the plating bath becomes large and part of the molten zinc ends up solidifying and the plating appearance sometimes deteriorates. If the sheet temperature before dipping is below the hot dip galvanization bath temperature—40° C., it is sufficient to further heat the sheet by any method before dipping it in the plating bath to control the sheet temperature to the hot dip galvanization bath temperature—40° C. or more and then dip the sheet in the plating bath. Further, if the temperature of the steel sheet at the time of dipping it in the plating batch is more than the hot dip galvanization bath temperature—+50° C., sometimes problems in operation will be caused along with the rise in the plating bath temperature.

(Pretreatment)

To further improve the plating adhesion, before annealing at a continuous hot dip galvanization line, the base material steel sheet may be given a plating comprised of Ni, Cu, Co, or Fe alone or in combination.

(Post-Treatment)

The surface of the hot dip galvanized steel sheet and hot dip galvannealed steel sheet may be given a top layer plating or treated in various ways, such as chromate treatment, phosphate treatment, treatment for improvement of the lubrication ability, and treatment for improvement of the weldability, for the purpose of improving the coatability and weldability.

(Skin Pass Rolling Reduction)

Further, skin pass rolling may be performed for the purpose of correcting the shape of the steel sheet or improving the ductility by introduction of mobile dislocations. The rolling reduction in the skin pass rolling after heat treatment is preferably 0.1 to 2.0% in range. If less than 0.1%, the effect is small and control is also difficult, so this becomes the lower limit. If more than 2.0%, the productivity remarkably falls, so this is made the upper limit. The skin pass rolling may be performed in-line or may be performed off-line. Further, the skin pass rolling may be performed at one time by the target rolling reduction or may be performed divided among several times. Further, the strength of the steel sheet after annealing becomes higher compared with the hot rolled steel sheet, so while the changes in surface roughness when rolling by the same rolling reduction will not be the same, the total of the cold rolling reduction and skin pass rolling reduction is preferably 20% or less from the object of maintaining the roughness formed at the hot rolled steel sheet.

According to the above method of production, it is possible to obtain steel sheet according to the above embodiment.

EXAMPLES

Below, examples according to the present invention will be shown. The present invention is not limited to these examples of conditions. The present invention can employ various conditions so long as not departing from the gist of the invention and achieving its object.

Example 1

Steels having various chemical compositions were smelted to produce steel slabs. Each of these steel slabs was loaded into furnaces heated to 1220° C., held there for 60 minutes for homogenization, then taken out into the atmosphere and hot rolled to obtain sheet thickness 1.8 mm steel sheet. In the hot rolling, the rolling reduction at one stand before the final stand of the finishing mill was made 35%, lubricant was supplied between the roll and sheet at one stand before the final stand, the end temperature of the finish rolling was 910° C., and the sheet was cooled down to 550° C. and then coiled. Next, the oxide scale of the hot rolled steel sheet was removed by pickling and the sheet was cold rolled by a rolling reduction of 1$^2$0.0% to finish the sheet thickness to 1.4 mm. Further, this cold rolled steel sheet was annealed, specifically was raised in temperature up to 860° C. and held at that temperature range for 130 seconds. Next, the annealed cold rolled steel sheet was cooled and made to dwell at 280° C., then was skin pass rolled. The chemical compositions obtained by analyzing samples taken from the obtained steel sheets are as shown in Tables 1-1 to 1-4. Note that, the balances other than the constituents shown in Tables 1-1 to 1-4 are comprised of Fe and impurities. Further, Tables 2-1 and 2-2 show the results of evaluation of the properties of the steel sheet heat treated by work in the above way.

Further, the methods of measurement of the "area ratios of structures of cold rolled annealed sheets" and the "tensile characteristics (tensile strength, total elongation, hole expandability) and "interval of step differences having height differences of more than 5.0 μm at the sheet surface" in Tables 2-1 and 2-2 are as explained above.

The "absorption energy at axial crushing" was evaluated by an axial crushing test of a hat-shaped member (50 mm square, 300 mm length, spot weld interval 30 mm joined with back plate of same material as member). First, steel sheet obtained in the above way was bent to prepare a shaped article having the above-mentioned predetermined open cross-sectional shape. The end part of the shaped article was fixed in place and a 900 kg weight was dropped from 2 meter height on to the opposite side to the fixed end part to thereby cause impact at a speed of 22 km/h at the impact end side of the shaped article in the axial direction. From the load-displacement curve at the time of the axial crushing test, the impact absorption energy up to 100 mm crushing was calculated. The criteria for evaluation of the absorbed energy are as follows: If an energy absorption of at least that shown by OK (fair), the sheet can be said to be suitable for automotive applications.

OK (pass): Absorption energy more than 5.5 kJ

OK (fair): Absorption energy more than 4.5 kJ and not more than 5.5 kJ

NG (fail): Absorption energy 4.5 kJ or less

TABLE 1-1

| Steel type | C | Si | Mn | P | S | Al | N | Ti | Co | Ni | Mo | Cr | O | B | Nb |
|---|---|---|---|---|---|---|---|---|---|---|---|---|---|---|---|
| A | 0.06 | 0.45 | 1.93 | 0.0164 | 0.0010 | 0.107 | 0.0015 | — | — | — | — | — | — | — | — |
| B | 0.13 | 0.31 | 1.50 | 0.0018 | 0.0039 | 0.058 | 0.0041 | — | — | — | — | — | — | — | — |
| C | 0.07 | 1.04 | 2.56 | 0.0019 | 0.0164 | 0.054 | 0.0153 | — | — | — | — | — | — | — | — |
| D | 0.14 | 1.20 | 2.43 | 0.0021 | 0.0018 | 0.054 | 0.0029 | — | — | — | — | — | — | — | — |
| E | 0.12 | 0.33 | 1.31 | 0.0010 | 0.0095 | 0.069 | 0.0013 | — | — | — | — | — | — | — | — |
| F | 0.14 | 0.65 | 1.21 | 0.0033 | 0.0020 | 0.775 | 0.0020 | — | — | — | — | — | — | — | — |
| G | 0.11 | 0.58 | 1.59 | 0.0014 | 0.0009 | 0.081 | 0.0009 | — | — | — | — | — | — | — | — |
| H | 0.11 | 1.28 | 2.76 | 0.0061 | 0.0162 | 0.161 | 0.0019 | — | — | — | — | — | — | — | — |
| I | 0.09 | 1.15 | 3.38 | 0.0028 | 0.0028 | 0.069 | 0.0012 | — | — | — | — | — | — | — | — |
| J | 0.10 | 1.01 | 2.28 | 0.0020 | 0.0018 | 0.393 | 0.0166 | — | — | — | — | — | 0.0006 | — | 0.039 |
| K | 0.12 | 0.37 | 2.81 | 0.0023 | 0.0020 | 0.102 | 0.0017 | — | — | — | — | — | — | — | 0.053 |
| L | 0.10 | 1.45 | 1.83 | 0.0018 | 0.0010 | 0.090 | 0.0030 | — | — | — | — | 0.140 | 0.0012 | 0.0016 | — |
| M | 0.10 | 0.73 | 1.96 | 0.0022 | 0.0020 | 0.127 | 0.0017 | — | — | — | — | — | — | 0.0006 | — |
| N | 0.14 | 0.89 | 1.22 | 0.0020 | 0.0021 | 0.848 | 0.0017 | — | — | — | — | 0.149 | — | — | — |
| O | 0.14 | 0.58 | 0.75 | 0.0032 | 0.0106 | 0.081 | 0.0070 | 0.049 | 0.086 | 0.042 | — | 1.692 | 0.0072 | — | — |
| P | 0.11 | 1.49 | 2.83 | 0.0021 | 0.0138 | 0.064 | 0.0010 | — | — | 0.085 | — | — | — | — | — |
| Q | 0.12 | 0.74 | 3.27 | 0.0123 | 0.0015 | 0.564 | 0.0020 | — | — | — | — | — | 0.0005 | — | — |
| R | 0.07 | 1.80 | 2.84 | 0.0031 | 0.0013 | 0.102 | 0.0023 | — | 0.032 | 0.055 | — | 0.182 | 0.0023 | — | — |
| S | 0.13 | 0.18 | 3.11 | 0.0082 | 0.0019 | 0.057 | 0.0127 | — | 0.062 | — | 0.053 | 0.195 | — | — | — |
| T | 0.07 | 1.66 | 3.62 | 0.0011 | 0.0012 | 0.067 | 0.0010 | — | — | — | — | — | — | 0.0022 | — |
| U | 0.13 | 0.08 | 1.54 | 0.0151 | 0.0011 | 0.714 | 0.0019 | — | — | — | — | — | — | — | 0.392 |
| V | 0.09 | 1.30 | 3.17 | 0.0013 | 0.0014 | 0.736 | 0.0013 | 0.042 | — | — | 0.056 | — | — | — | 0.334 |
| W | 0.09 | 1.30 | 1.92 | 0.0022 | 0.0017 | 0.048 | 0.0134 | — | — | 0.381 | 0.065 | 0.335 | — | 0.0013 | — |
| X | 0.08 | 0.80 | 2.40 | 0.0021 | 0.0156 | 0.106 | 0.0022 | 0.376 | 0.361 | — | 0.041 | — | — | — | 0.042 |
| Y | 0.12 | 0.34 | 3.13 | 0.0028 | 0.0156 | 0.223 | 0.0163 | — | — | 0.400 | — | — | 0.0012 | 0.0031 | 0.095 |
| Z | 0.11 | 1.37 | 3.87 | 0.0014 | 0.0026 | 0.126 | 0.0020 | 0.044 | — | — | 0.035 | 0.128 | 0.0011 | — | — |
| AA | 0.13 | 1.77 | 3.11 | 0.0018 | 0.0014 | 0.049 | 0.0031 | — | — | 0.060 | — | 0.179 | — | — | — |
| AB | 0.09 | 1.81 | 2.14 | 0.0052 | 0.0025 | 0.089 | 0.0029 | — | 0.052 | — | — | 0.186 | — | — | — |
| AC | 0.05 | 1.07 | 2.17 | 0.0017 | 0.0029 | 0.098 | 0.0145 | — | 0.038 | — | 0.048 | — | 0.0008 | — | — |
| AD | 0.11 | 1.93 | 1.71 | 0.0021 | 0.0018 | 0.224 | 0.0051 | 0.046 | 0.031 | — | — | — | — | — | 0.048 |
| AE | 0.12 | 0.47 | 1.72 | 0.0016 | 0.0083 | 0.106 | 0.0021 | — | — | — | — | — | — | 0.0036 | 0.033 |
| AF | 0.06 | 1.74 | 3.33 | 0.0093 | 0.0019 | 0.100 | 0.0012 | 0.409 | — | — | 0.035 | — | 0.0011 | 0.0011 | — |
| AG | 0.08 | 0.98 | 3.39 | 0.0065 | 0.0021 | 0.045 | 0.0011 | 0.233 | — | — | 0.054 | 1.431 | 0.0018 | 0.0014 | — |
| AH | 0.07 | 0.83 | 3.59 | 0.0013 | 0.0029 | 0.126 | 0.0017 | — | — | — | — | 0.772 | — | 0.0066 | 0.044 |
| AI | 0.12 | 1.29 | 3.82 | 0.0037 | 0.0154 | 0.286 | 0.0077 | 0.026 | 0.056 | 0.037 | — | — | — | 0.0009 | — |
| AJ | 0.13 | 0.18 | 2.28 | 0.0017 | 0.0018 | 0.103 | 0.0012 | — | 0.387 | 0.060 | — | — | — | — | — |
| AK | 0.13 | 1.37 | 2.66 | 0.0018 | 0.0051 | 0.084 | 0.0015 | 0.338 | 0.116 | 0.035 | — | — | — | — | 0.043 |
| AL | 0.07 | 1.52 | 3.77 | 0.0024 | 0.0015 | 0.153 | 0.0158 | 0.059 | — | 0.042 | 0.322 | — | 0.0006 | — | — |
| AM | 0.10 | 1.76 | 2.16 | 0.0160 | 0.0021 | 0.818 | 0.0012 | — | — | — | — | — | 0.0005 | — | — |

TABLE 1-2

| Steel type | V | Cu | W | Ta | Sn | Sb | As | Mg | Ca | Y | Zr | La | Ce | Ae1 (° C.) | Ae3 (° C.) | Re-marks |
|---|---|---|---|---|---|---|---|---|---|---|---|---|---|---|---|---|
| A | — | — | — | — | — | — | — | — | — | — | — | — | — | 662 | 849 | Inv. steel |
| B | — | — | — | — | — | — | — | — | — | — | — | — | — | 684 | 830 | Inv. steel |
| C | — | — | — | — | — | — | — | — | — | — | — | — | — | 642 | 839 | Inv. steel |
| D | — | — | — | — | — | — | — | — | — | — | — | — | — | 661 | 828 | Inv. steel |
| E | — | — | — | — | — | — | — | — | — | — | — | — | — | 691 | 842 | Inv. steel |
| F | — | — | — | — | — | — | — | — | — | — | — | — | — | 713 | 941 | Inv. steel |
| G | — | — | — | — | — | — | — | — | — | — | — | — | — | 683 | 847 | Inv. steel |
| H | — | — | — | — | — | — | — | — | — | — | — | — | — | 644 | 842 | Inv. steel |
| I | — | — | — | — | — | — | — | — | — | — | — | — | — | 601 | 809 | Inv. steel |
| J | — | — | — | 0.0066 | 0.0109 | 0.0098 | — | 0.0036 | — | 0.0040 | — | 0.0328 | — | 665 | 884 | Inv. steel |
| K | — | — | 0.0074 | 0.0057 | 0.0063 | — | 0.0034 | 0.0036 | — | — | — | 0.0032 | 0.0019 | 628 | 801 | Inv. steel |

TABLE 1-2-continued

| Steel type | V | Cu | W | Ta | Sn | Sb | As | Mg | Ca | Y | Zr | La | Ce | Ae1 (° C.) | Ae3 (° C.) | Re-marks |
|---|---|---|---|---|---|---|---|---|---|---|---|---|---|---|---|---|
| L | — | — | — | — | 0.0170 | — | — | — | — | 0.0066 | 0.0063 | 0.0423 | — | 690 | 880 | Inv. steel |
| M | 0.411 | — | 0.0578 | — | — | — | 0.0052 | — | — | — | — | 0.0039 | — | 670 | 849 | Inv. steel |
| N | — | — | 0.0159 | — | — | — | 0.0067 | 0.0282 | — | — | 0.0053 | — | — | 721 | 970 | Inv. steel |
| O | — | 0.050 | — | — | — | — | — | — | 0.0063 | — | — | — | — | 745 | 845 | Inv. steel |
| P | — | — | — | 0.0077 | — | 0.0034 | — | 0.0082 | 0.0033 | — | — | 0.0070 | — | 640 | 832 | Inv. steel |
| Q | 0.036 | — | — | — | — | 0.0056 | — | — | — | 0.0118 | — | 0.0061 | — | 613 | 849 | Inv. steel |
| R | — | 0.021 | 0.0058 | 0.0069 | 0.0081 | — | 0.0036 | — | 0.0041 | — | — | 0.0031 | — | 645 | 863 | Inv. steel |
| S | — | — | — | — | — | — | — | — | — | — | 0.0135 | — | — | 613 | 779 | Inv. steel |
| T | 0.080 | 0.036 | — | — | — | — | 0.0034 | 0.0040 | 0.0268 | 0.0324 | — | — | — | 592 | 824 | Inv. steel |
| U | — | — | — | — | — | — | — | 0.0019 | — | 0.0030 | 0.0105 | 0.0048 | — | 692 | 902 | Inv. steel |
| V | — | — | — | — | 0.0058 | — | — | 0.0377 | — | — | 0.0384 | — | — | 627 | 913 | Inv. steel |
| W | — | — | 0.0043 | — | — | — | 0.0240 | — | 0.0157 | — | 0.0153 | — | 0.0029 | 674 | 850 | Inv. steel |
| X | 0.066 | — | 0.0751 | — | 0.0021 | 0.0060 | 0.0053 | — | 0.0398 | — | — | 0.0345 | — | 649 | 840 | Inv. steel |
| Y | — | — | — | 0.0076 | 0.0413 | 0.0047 | — | — | — | 0.0029 | — | 0.0392 | 0.0047 | 582 | 794 | Inv. steel |
| Z | 0.033 | 0.323 | — | — | — | — | — | — | — | — | — | — | — | 582 | 801 | Inv. steel |
| AA | — | — | 0.0084 | 0.0567 | — | — | — | — | — | — | — | — | — | 638 | 823 | Inv. steel |
| AB | 0.052 | 0.385 | 0.0123 | — | 0.0029 | 0.0081 | — | 0.0025 | 0.0028 | — | 0.0045 | — | — | 685 | 888 | Inv. steel |
| AC | — | 0.045 | — | — | — | — | — | — | — | — | — | 0.0426 | — | 661 | 871 | Inv. steel |
| AD | — | — | 0.0057 | 0.0714 | 0.0060 | 0.0019 | — | — | — | — | — | — | — | 705 | 934 | Inv. steel |
| AE | 0.038 | — | — | 0.0082 | — | — | 0.0038 | 0.0037 | 0.0039 | 0.0034 | 0.0397 | — | 0.0374 | 678 | 838 | Inv. steel |
| AF | — | — | — | — | — | — | — | — | — | — | 0.0059 | — | — | 611 | 848 | Inv. steel |
| AG | 0.061 | 0.048 | — | 0.0093 | — | — | — | — | 0.0106 | 0.0034 | 0.0022 | — | — | 600 | 788 | Inv. steel |
| AH | 0.041 | 0.038 | — | — | — | — | 0.0042 | — | — | — | — | — | 0.0042 | 573 | 796 | Inv. steel |
| AI | — | 0.044 | — | 0.0444 | 0.0392 | — | 0.0058 | 0.0052 | — | — | — | — | 0.0036 | 584 | 815 | Inv. steel |
| AJ | — | — | — | 0.0124 | — | — | 0.0043 | — | — | 0.0066 | — | — | 0.0086 | 649 | 806 | Inv. steel |
| AK | — | — | 0.0075 | — | — | — | — | 0.0105 | — | — | 0.0330 | 0.0034 | 0.0035 | 651 | 832 | Inv. steel |
| AL | — | 0.035 | — | 0.0101 | 0.0052 | — | — | — | 0.0239 | — | 0.0046 | 0.0051 | — | 400 | 832 | Inv. steel |
| AM | 0.088 | — | — | — | — | — | — | — | — | 0.0405 | 0.0042 | — | — | 693 | 1000 | Inv. steel |

TABLE 1-3

| Steel type | C | Si | Mn | P | S | Al | N | Ti | Co | Ni | Mo | Cr | O | B | Nb |
|---|---|---|---|---|---|---|---|---|---|---|---|---|---|---|---|
| AN | 0.04 | 1.72 | 0.33 | 0.0018 | 0.0024 | 0.113 | 0.0073 | 0.400 | 0.343 | 0.048 | — | — | — | — | — |
| AO | 0.16 | 1.82 | 3.62 | 0.0027 | 0.0064 | 0.098 | 0.0025 | — | 0.046 | — | 0.041 | — | 0.0074 | — | 0.174 |
| AP | 0.10 | 2.06 | 2.72 | 0.0011 | 0.0029 | 0.106 | 0.0010 | — | — | — | — | — | — | — | — |
| AQ | 0.10 | 0.39 | 4.13 | 0.0137 | 0.0029 | 0.063 | 0.0160 | — | — | — | — | — | — | — | — |
| AR | 0.07 | 1.35 | 1.27 | 0.0206 | 0.0018 | 0.189 | 0.0043 | — | 0.044 | — | 0.045 | — | 0.0082 | — | 0.061 |
| AS | 0.12 | 1.67 | 2.81 | 0.0088 | 0.0208 | 0.080 | 0.0013 | — | 0.055 | 0.093 | — | 0.169 | 0.0010 | — | — |
| AT | 0.13 | 0.18 | 3.15 | 0.0013 | 0.0119 | 1.024 | 0.0036 | 0.312 | — | 0.411 | 0.118 | 0.203 | — | — | 0.039 |
| AU | 0.06 | 0.25 | 3.62 | 0.0020 | 0.0017 | 0.054 | 0.0207 | — | — | — | — | — | 0.0009 | — | 0.268 |
| AV | 0.06 | 1.53 | 1.17 | 0.0020 | 0.0158 | 0.085 | 0.0021 | 0.515 | 0.041 | — | — | 0.126 | — | — | — |
| AW | 0.13 | 1.41 | 3.49 | 0.0010 | 0.0093 | 0.086 | 0.0153 | — | 0.516 | 0.039 | — | — | — | — | — |

TABLE 1-3-continued

| Steel type | C | Si | Mn | P | S | Al | N | Ti | Co | Ni | Mo | Cr | O | B | Nb |
|---|---|---|---|---|---|---|---|---|---|---|---|---|---|---|---|
| AX | 0.07 | 1.07 | 2.12 | 0.0023 | 0.0013 | 0.038 | 0.0155 | 0.048 | 0.263 | 0.514 | — | — | — | — | 0.047 |
| AY | 0.09 | 0.54 | 0.91 | 0.0022 | 0.0021 | 0.088 | 0.0134 | — | — | — | 0.515 | — | 0.0009 | — | — |
| AZ | 0.07 | 1.93 | 0.95 | 0.0022 | 0.0018 | 0.669 | 0.0010 | — | 0.168 | 0.041 | — | 2.047 | 0.0080 | 0.0057 | — |
| BA | 0.11 | 0.90 | 0.65 | 0.0139 | 0.0024 | 0.094 | 0.0020 | — | — | — | — | 0.160 | 0.0103 | — | — |
| BB | 0.06 | 1.90 | 1.58 | 0.0020 | 0.0022 | 0.825 | 0.0025 | 0.043 | — | 0.048 | 0.056 | — | 0.0007 | 0.0102 | — |
| BC | 0.14 | 0.44 | 1.77 | 0.0029 | 0.0160 | 0.257 | 0.0019 | — | — | — | — | — | — | — | 0.513 |
| BD | 0.13 | 0.12 | 1.99 | 0.0068 | 0.0013 | 0.082 | 0.0149 | — | — | — | — | — | — | — | 0.021 |
| BE | 0.11 | 1.23 | 1.63 | 0.0009 | 0.0012 | 0.108 | 0.0173 | 0.033 | — | — | 0.259 | — | — | — | 0.047 |
| BF | 0.12 | 1.54 | 3.77 | 0.0009 | 0.0149 | 0.827 | 0.0050 | — | — | — | — | 0.638 | 0.0011 | 0.0043 | — |
| BG | 0.07 | 1.54 | 1.97 | 0.0121 | 0.0016 | 0.242 | 0.0013 | — | — | — | — | — | — | — | 0.413 |
| BH | 0.14 | 1.42 | 3.29 | 0.0030 | 0.0017 | 0.108 | 0.0106 | — | 0.053 | — | 0.030 | 0.194 | — | — | — |
| BI | 0.07 | 1.28 | 0.72 | 0.0023 | 0.0168 | 0.096 | 0.0022 | — | — | 0.055 | — | 0.196 | — | — | — |
| BJ | 0.08 | 1.73 | 1.45 | 0.0171 | 0.0017 | 0.096 | 0.0023 | — | — | — | | 0.082 | — | — | — |
| BK | 0.12 | 0.14 | 0.82 | 0.0012 | 0.0020 | 0.449 | 0.0013 | — | 0.040 | — | — | — | — | 0.0005 | — |
| BL | 0.08 | 0.76 | 3.05 | 0.0025 | 0.0132 | 0.113 | 0.0022 | 0.409 | 0.379 | — | 0.034 | — | — | — | 0.096 |
| BM | 0.10 | 1.15 | 2.79 | 0.0053 | 0.0017 | 0.181 | 0.0009 | — | — | — | 0.034 | 1.508 | — | — | — |
| BN | 0.14 | 1.77 | 2.70 | 0.0153 | 0.0169 | 0.338 | 0.0024 | — | — | — | — | 1.424 | — | 0.0013 | 0.052 |
| BO | 0.07 | 0.91 | 2.08 | 0.0012 | 0.0028 | 0.140 | 0.0017 | — | — | — | — | — | 0.0015 | — | — |
| BP | 0.06 | 1.31 | 3.09 | 0.0028 | 0.0013 | 0.083 | 0.0020 | — | — | — | — | — | — | 0.0008 | — |

TABLE 1-4

| Steel type | V | Cu | W | Ta | Sn | St | As | Mg | Ca | Y | Zr | La | Ce | Ae1 (° C.) | Ae3 (° C.) | Re-marks |
|---|---|---|---|---|---|---|---|---|---|---|---|---|---|---|---|---|
| AN | 0.037 | — | — | — | — | 0.0056 | — | — | — | — | — | — | 0.0382 | 745 | 1000 | Comp. steel |
| AO | 0.033 | 0.044 | — | — | — | 0.0025 | — | 0.0377 | — | 0.0036 | — | — | — | 620 | 809 | Comp. steel |
| AP | — | — | — | — | — | — | — | — | — | — | — | — | — | 660 | 876 | Comp. steel |
| AQ | — | — | — | — | — | — | — | — | — | — | — | — | — | 529 | 765 | Comp. steel |
| AR | 0.284 | 0.056 | — | — | — | 0.0303 | — | 0.0182 | — | 0.0034 | — | — | — | 708 | 937 | Comp. steel |
| AS | — | 0.053 | 0.0068 | 0.0397 | 0.0045 | — | 0.0029 | — | 0.0031 | — | — | 0.0023 | — | 648 | 836 | Comp. steel |
| AT | — | — | 0.0084 | — | — | — | — | 0.0037 | — | — | — | — | 0.0021 | 601 | 867 | Comp. steel |
| AU | — | — | — | 0.0147 | 0.0050 | 0.0247 | — | 0.0098 | — | 0.0049 | — | 0.0038 | — | 548 | 782 | Comp. steel |
| AV | 0.404 | 0.066 | 0.0420 | — | 0.0418 | 0.0051 | — | 0.0143 | 0.0041 | — | 0.0036 | — | — | 716 | 938 | Comp. steel |
| AW | — | — | — | 0.0140 | — | — | 0.0032 | — | — | 0.0118 | — | — | 0.0059 | 609 | 804 | Comp. steel |
| AX | — | — | 0.0073 | 0.0105 | 0.0141 | 0.0108 | — | — | — | — | — | — | — | 643 | 837 | Comp. steel |
| AY | 0.065 | — | — | — | — | 0.0044 | — | — | — | 0.0058 | — | 0.0400 | — | 400 | 894 | Comp. steel |
| AZ | 0.046 | — | — | — | — | 0.0036 | — | 0.0032 | — | — | — | — | 0.0226 | 784 | 1000 | Comp. steel |
| BA | — | — | 0.0049 | — | — | — | 0.0061 | 0.0037 | — | — | 0.0340 | — | — | 726 | 900 | Comp. steel |
| BB | — | 0.115 | — | 0.0085 | 0.0057 | — | — | — | 0.0301 | — | 0.0050 | 0.0037 | — | 717 | 1000 | Comp. steel |
| BC | — | — | — | — | — | — | — | 0.0042 | — | 0.0122 | 0.0040 | 0.0031 | — | 680 | 848 | Comp. steel |
| BD | 0.511 | — | 0.0060 | 0.0077 | 0.0261 | — | 0.0187 | 0.0024 | — | — | — | 0.0045 | 0.0059 | 663 | 812 | Comp. steel |
| BE | — | 0.512 | — | — | 0.0037 | — | — | 0.0404 | — | — | 0.0041 | — | — | 400 | 885 | Comp. steel |
| BF | — | — | 0.1036 | — | 0.0362 | — | — | — | — | 0.0029 | 0.0039 | 0.0047 | — | 606 | 882 | Comp. steel |
| BG | — | — | 0.0111 | 0.1021 | — | 0.0037 | 0.0113 | — | — | 0.0083 | — | — | — | 683 | 919 | Comp. steel |
| BH | — | — | — | — | 0.0518 | — | — | — | — | — | 0.0247 | — | — | 628 | 808 | Comp. steel |
| BI | — | — | 0.0062 | 0.0816 | — | 0.0517 | — | — | — | — | — | — | — | 729 | 938 | Comp. steel |
| BJ | — | — | — | — | — | — | 0.0510 | — | 0.0066 | 0.0401 | — | — | 0.0050 | 709 | 928 | Comp. steel |
| BK | — | — | — | 0.0766 | 0.0026 | 0.0174 | — | 0.0520 | 0.0198 | 0.0069 | 0.0059 | — | — | 712 | 902 | Comp. steel |

TABLE 1-4-continued

| Steel type | V | Cu | W | Ta | Sn | St | As | Mg | Ca | Y | Zr | La | Ce | Ae1 (° C.) | Ae3 (° C.) | Remarks |
|---|---|---|---|---|---|---|---|---|---|---|---|---|---|---|---|---|
| BL | 0.060 | — | 0.0071 | — | 0.0021 | 0.0026 | 0.0049 | — | 0.0519 | — | — | 0.0038 | — | 612 | 817 | Comp. steel |
| BM | — | 0.027 | — | — | — | 0.0047 | — | — | 0.0324 | 0.0519 | — | — | 0.0046 | 657 | 823 | Comp. steel |
| BN | 0.051 | 0.038 | — | — | — | — | 0.0048 | — | — | — | 0.0517 | — | 0.0073 | 686 | 852 | Comp. steel |
| BO | 0.043 | — | — | — | — | — | — | — | — | 0.0045 | 0.0047 | 0.0515 | — | 665 | 864 | Comp. steel |
| BP | 0.045 | 0.035 | — | — | — | — | 0.0029 | 0.0019 | 0.0051 | 0.0020 | — | — | 0.0517 | 615 | 836 | Comp. steel |

TABLE 2-1

| | | Production conditions | | | Area ratios of structures of cold rolled and annealed sheets (%) | | | |
|---|---|---|---|---|---|---|---|---|
| No. | Steel type | Rolling reduction at one stand before final stand of finishing mill (%) | Coiling temp. of hot rolled steel sheet (° C.) | Cold rolling reduction (%) | Total of ferrite, pearlite, and bainite | Retained austenite | Tempered martensite | Martensite |
| A-1 | A | 35 | 550 | 12.0 | 26.3 | 0.0 | 1.6 | 72.1 |
| B-1 | B | 35 | 550 | 12.0 | 33.5 | 0.0 | 3.5 | 63.0 |
| C-1 | C | 35 | 550 | 12.0 | 7.1 | 0.0 | 3.8 | 89.1 |
| D-1 | D | 35 | 550 | 12.0 | 5.3 | 0.0 | 10.6 | 84.1 |
| E-1 | E | 35 | 550 | 12.0 | 41.7 | 0.0 | 2.6 | 55.7 |
| F-1 | F | 35 | 550 | 12.0 | 56.3 | 0.1 | 10.7 | 32.9 |
| G-1 | G | 35 | 550 | 12.0 | 29.4 | 0.0 | 3.0 | 67.6 |
| H-1 | H | 35 | 550 | 12.0 | 3.5 | 0.0 | 9.0 | 87.5 |
| I-1 | I | 35 | 550 | 12.0 | 1.5 | 0.0 | 10.2 | 88.3 |
| J-1 | J | 35 | 550 | 12.0 | 25.8 | 0.0 | 5.7 | 68.5 |
| K-1 | K | 35 | 550 | 12.0 | 5.5 | 0.0 | 8.1 | 86.4 |
| L-1 | L | 35 | 550 | 12.0 | 27.9 | 0.0 | 4.9 | 67.2 |
| M-1 | M | 35 | 550 | 12.0 | 17.9 | 0.0 | 3.5 | 78.6 |
| N-1 | N | 35 | 550 | 12.0 | 59.2 | 0.1 | 13.0 | 27.7 |
| O-1 | O | 35 | 550 | 12.0 | 12.5 | 0.0 | 4.0 | 83.5 |
| P-1 | P | 35 | 550 | 12.0 | 2.5 | 0.0 | 10.6 | 86.9 |
| Q-1 | Q | 35 | 550 | 12.0 | 2.0 | 0.0 | 12.8 | 85.2 |
| R-1 | R | 35 | 550 | 12.0 | 4.8 | 0.0 | 6.6 | 88.6 |
| S-1 | S | 35 | 550 | 12.0 | 2.3 | 0.0 | 11.6 | 86.1 |
| T-1 | T | 35 | 550 | 12.0 | 0.8 | 0.0 | 10.6 | 88.6 |
| U-1 | U | 35 | 550 | 12.0 | 49.3 | 0.0 | 5.1 | 45.6 |
| V-1 | V | 35 | 550 | 12.0 | 30.7 | 0.0 | 11.3 | 58.0 |
| W-1 | W | 35 | 550 | 12.0 | 6.0 | 0.0 | 4.6 | 89.4 |
| X-1 | X | 35 | 550 | 12.0 | 8.8 | 0.0 | 3.7 | 87.5 |
| Y-1 | Y | 35 | 550 | 12.0 | 2.4 | 0.0 | 12.0 | 85.6 |
| Z-1 | Z | 35 | 550 | 12.0 | 0.4 | 0.0 | 21.9 | 77.7 |
| AA-1 | AA | 35 | 550 | 12.0 | 0.9 | 0.0 | 19.3 | 79.8 |
| AB-1 | AB | 35 | 550 | 12.0 | 28.6 | 0.0 | 6.2 | 65.2 |
| AC-1 | AC | 35 | 550 | 12.0 | 23.7 | 0.0 | 2.0 | 74.3 |
| AD-1 | AD | 35 | 550 | 12.0 | 50.0 | 0.0 | 9.9 | 40.1 |
| AE-1 | AE | 35 | 550 | 12.0 | 25.3 | 0.0 | 3.7 | 71.0 |
| AF-1 | AF | 35 | 550 | 12.0 | 1.2 | 0.0 | 7.5 | 91.3 |
| AG-1 | AG | 35 | 550 | 12.0 | 0.2 | 0.0 | 12.1 | 87.7 |
| AH-1 | AH | 35 | 550 | 12.0 | 0.5 | 0.0 | 9.6 | 89.9 |
| AI-1 | AI | 35 | 550 | 12.0 | 0.5 | 0.0 | 23.0 | 76.5 |
| AJ-1 | AJ | 35 | 550 | 12.0 | 12.7 | 0.0 | 6.1 | 81.2 |
| AK-1 | AK | 35 | 550 | 12.0 | 3.3 | 0.0 | 11.7 | 85.0 |

TABLE 2-1-continued

| | | | | | | | | |
|---|---|---|---|---|---|---|---|---|
| AL-1 | AL | 35 | 550 | 12.0 | 0.2 | 0.0 | 12.8 | 87.0 |
| AM-1 | AM | 35 | 550 | 12.0 | 59.6 | 0.1 | 15.0 | 25.3 |

| | | | Tensile properties | | | Properties | | |
|---|---|---|---|---|---|---|---|---|
| No. | Steel type | Tensile strength TS (MPa) | Total elongation t-El(%) | Hole expandability λ (%) | Interval of step differences having height difference of more than 5.0 μm at sheet surface (mm) | Absorption energy at axial crushing | Remarks |
| A-1 | A | 1058 | 12.1 | 33.1 | 1.6 | OK | Inv. ex. |
| B-1 | B | 1181 | 11.0 | 25.6 | 1.9 | OK | Inv. ex. |
| C-1 | C | 1217 | 11.4 | 56.1 | 1.1 | OK | Inv. ex. |
| D-1 | D | 1399 | 10.4 | 50.9 | 1.2 | OK | Inv. ex. |
| E-1 | E | 1097 | 11.8 | 21.5 | 1.2 | OK | Inv. ex. |
| F-1 | F | 1083 | 13.3 | 20.9 | 1.1 | OK | Inv. ex. |
| G-1 | G | 1166 | 11.5 | 28.8 | 0.8 | OK | Inv. ex. |
| H-1 | H | 1331 | 10.9 | 56.8 | 1.3 | OK | Inv. ex. |
| I-1 | I | 1296 | 10.7 | 61.9 | 0.7 | OK | Inv. ex. |
| J-1 | J | 1172 | 12.2 | 32.1 | 0.6 | OK | Inv. ex. |
| K-1 | K | 1340 | 9.6 | 53.2 | 1.0 | OK | Inv. ex. |
| L-1 | L | 1170 | 12.7 | 30.1 | 1.1 | OK | Inv. ex. |
| M-1 | M | 1217 | 11.2 | 40.2 | 1.6 | OK | Inv. ex. |
| N-1 | N | 1045 | 14.2 | 22.0 | 0.6 | OK | Inv. ex. |
| O-1 | O | 1354 | 10.5 | 43.2 | 1.1 | OK | Inv. ex. |
| P-1 | P | 1340 | 11.0 | 57.9 | 0.8 | OK | Inv. ex. |
| Q-1 | Q | 1365 | 10.2 | 57.4 | 0.7 | OK | Inv. ex. |
| R-1 | R | 1217 | 12.4 | 60.0 | 0.6 | OK | Inv. ex. |
| S-1 | S | 1382 | 9.0 | 56.0 | 1.5 | OK | Inv. ex. |
| T-1 | T | 1258 | 11.6 | 65.2 | 1.0 | OK | Inv. ex. |
| U-1 | U | 1059 | 12.4 | 20.0 | 1.4 | OK | Inv. ex. |
| V-1 | V | 1132 | 13.0 | 28.0 | 0.4 | OK | Inv. ex. |
| W-1 | W | 1278 | 11.5 | 55.3 | 0.5 | OK | Inv. ex. |
| X-1 | X | 1224 | 11.1 | 53.0 | 1.7 | OK | Inv. ex. |
| Y-1 | Y | 1355 | 9.5 | 57.3 | 1.2 | OK | Inv. ex. |
| Z-1 | Z | 1358 | 10.4 | 60.3 | 0.5 | OK | Inv. ex. |
| AA-1 | AA | 1380 | 11.0 | 58.3 | 1.7 | OK | Inv. ex. |
| AB-1 | AB | 1151 | 13.3 | 29.7 | 1.5 | OK | Inv. ex. |
| AC-1 | AC | 1063 | 13.0 | 36.0 | 0.5 | OK | Inv. ex. |
| AD-1 | AD | 1076 | 14.7 | 20.0 | 1.0 | OK | Inv. ex. |
| AE-1 | AE | 1217 | 10.9 | 32.0 | 0.5 | OK | Inv. ex. |
| AF-1 | AF | 1217 | 12.1 | 66.7 | 1.2 | OK | Inv. ex. |

TABLE 2-1-continued

| | | | | | | | |
|---|---|---|---|---|---|---|---|
| AG-1 | AG | 1285 | 10.5 | 64.8 | 1.4 | OK | Inv. ex. |
| AH-1 | AH | 1260 | 10.4 | 65.6 | 0.6 | OK | Inv. ex. |
| AI-1 | AI | 1377 | 10.4 | 59.1 | 1.4 | OK | Inv. ex. |
| AJ-1 | AJ | 1312 | 9.7 | 44.3 | 0.8 | OK | Inv. ex. |
| AK-1 | AK | 1385 | 10.7 | 54.4 | 1.3 | OK | Inv. ex. |
| AL-1 | AL | 1268 | 11.3 | 65.8 | 1.2 | OK | Inv. ex. |
| AM-1 | AM | 1000 | 15.8 | 22.3 | 1.6 | OK | Inv. ex. |

TABLE 2-2

| | | Production conditions | | | Area ratios of structures of cold rolled and annealed sheets (%) | | | |
|---|---|---|---|---|---|---|---|---|
| No. | Steel type | Rolling reduction at one stand before final stand of finishing mill (%) | Coiling temp. of hot rolled steel sheet (° C.) | Cold rolling reduction (%) | Total of ferrite, pearlite, and bainite | Retained austenite | Tempered martensite | Martensite |
| AN-1 | AN | 35 | 550 | 12.0 | 92.5 | 0.1 | 5.0 | 2.4 |
| AO-1 | AO | 35 | 550 | 12.0 | 0.4 | 1.1 | 38.8 | 59.7 |
| AP-1 | AP | 35 | 550 | 12.0 | 15.1 | 1.2 | 10.6 | 73.1 |
| AQ-1 | AQ | 35 | 550 | 12.0 | 0.7 | 0.0 | 16.2 | 83.1 |
| AR-1 | AR | 35 | 550 | 12.0 | 67.5 | 0.0 | 3.1 | 29.4 |
| AS-1 | AS | 35 | 550 | 12.0 | 1.7 | 0.0 | 13.3 | 85.0 |
| AT-1 | AT | 35 | 550 | 12.0 | 65.7 | 0.4 | 15.1 | 18.8 |
| AU-1 | AU | 35 | 550 | 12.0 | 2.2 | 0.0 | 5.6 | 92.2 |
| AV-1 | AV | 35 | 550 | 12.0 | 71.8 | 0.0 | 2.6 | 25.6 |
| AW-1 | AW | 35 | 550 | 12.0 | 0.8 | 0.0 | 21.5 | 77.7 |
| AX-1 | AX | 35 | 550 | 12.0 | 9.6 | 0.0 | 3.4 | 87.0 |
| AY-1 | AY | 35 | 550 | 12.0 | 47.7 | 0.0 | 2.2 | 50.1 |
| AZ-1 | AZ | 35 | 550 | 12.0 | 77.8 | 4.3 | 11.9 | 6.0 |
| BA-1 | BA | 35 | 550 | 12.0 | 66.0 | 0.0 | 3.1 | 30.9 |
| BB-1 | BB | 35 | 550 | 12.0 | 82.1 | 0.1 | 10.5 | 7.3 |
| BC-1 | BC | 35 | 550 | 12.0 | 21.9 | 0.0 | 5.2 | 72.9 |
| BD-1 | BD | 35 | 550 | 12.0 | 20.5 | 0.0 | 4.7 | 74.8 |
| BE-1 | BE | 35 | 550 | 12.0 | 29.7 | 0.0 | 5.2 | 65.1 |
| BF-1 | BF | 35 | 550 | 12.0 | 12.3 | 0.1 | 29.8 | 57.8 |
| BG-1 | BG | 35 | 550 | 12.0 | 50.4 | 0.0 | 3.9 | 45.7 |
| BH-1 | BH | 35 | 550 | 12.0 | 0.7 | 0.0 | 25.3 | 74.0 |
| BI-1 | BI | 35 | 550 | 12.0 | 76.2 | 0.0 | 2.7 | 21.1 |
| BJ-1 | BJ | 35 | 550 | 12.0 | 58.8 | 0.0 | 4.4 | 36.8 |
| BK-1 | BK | 35 | 550 | 12.0 | 68.8 | 0.1 | 3.0 | 28.1 |
| BL-1 | BL | 35 | 550 | 12.0 | 3.2 | 0.0 | 6.0 | 90.8 |
| BM-1 | BM | 35 | 550 | 12.0 | 0.4 | 0.0 | 11.2 | 88.4 |
| BN-1 | BN | 35 | 550 | 12.0 | 0.3 | 0.0 | 24.4 | 75.3 |
| BO-1 | BO | 35 | 550 | 12.0 | 20.1 | 0.0 | 2.5 | 77.4 |
| BP-1 | BP | 35 | 550 | 12.0 | 2.6 | 0.0 | 5.3 | 92.1 |

| | | Tensile properties | | | Properties | | |
|---|---|---|---|---|---|---|---|
| No. | Steel type | Tensile strength TS (MPa) | Total elongation t-El(%) | Hole expandability λ (%) | Interval of step differences having height difference of more than 5.0 μm at sheet surface (mm) | Absorption energy at axial crushing | Remarks |
| AN-1 | AN | 596 | 25.1 | 81.1 | 1.7 | NG | Comp. ex. |
| AO-1 | AO | 1417 | 4.5 | 57.0 | 0.8 | NG | Comp. ex. |
| AP-1 | AP | 1252 | 12.9 | 42.9 | 3.9 | NG | Comp. ex. |

TABLE 2-2-continued

| | | | | | | | |
|---|---|---|---|---|---|---|---|
| AQ-1 | AQ | 1318 | 9.2 | 62.1 | 4.0 | NG | Comp. ex. |
| AR-1 | AR | 861 | 16.8 | 28.5 | 1.3 | NG | Comp. ex. |
| AS-1 | AS | 1357 | 11.2 | 58.3 | 2.6 | NG | Comp. ex. |
| AT-1 | AT | 751 | 16.5 | 27.5 | 7.9 | NG | Comp. ex. |
| AU-1 | AU | 1211 | 9.8 | 65.1 | 4.3 | NG | Comp. ex. |
| AV-1 | AV | 806 | 18.1 | 33.8 | 9.7 | NG | Comp. ex. |
| AW-1 | AW | 1403 | 10.3 | 57.2 | 9.1 | NG | Comp. ex. |
| AX-1 | AX | 1197 | 11.7 | 52.8 | 5.8 | NG | Comp. ex. |
| AY-1 | AY | 976 | 13.6 | 20.1 | 9.4 | NG | Comp. ex. |
| AZ-1 | AZ | 786 | 21.3 | 42.8 | 1.6 | NG | Comp. ex. |
| BA-1 | BA | 941 | 14.9 | 26.6 | 6.2 | NG | Comp. ex. |
| BB-1 | BB | 755 | 21.0 | 51.1 | 10.0 | NG | Comp. ex. |
| BC-1 | BC | 1283 | 10.5 | 34.3 | 8.2 | NG | Comp. ex. |
| BD-1 | BD | 1259 | 10.0 | 36.2 | 9.1 | NG | Comp. ex. |
| BE-1 | BE | 1183 | 12.4 | 28.4 | 4.0 | NG | Comp. ex. |
| BF-1 | BF | 1336 | 11.5 | 44.0 | 5.5 | NG | Comp. ex. |
| BG-1 | BG | 979 | 15.1 | 20.0 | 8.1 | NG | Comp. ex. |
| BH-1 | BH | 1456 | 10.1 | 54.4 | 6.5 | NG | Comp. ex. |
| BI-1 | BI | 778 | 18.4 | 40.3 | 3.4 | NG | Comp. ex. |
| BJ-1 | BJ | 952 | 15.9 | 22.0 | 2.7 | NG | Comp. ex. |
| BK-1 | BK | 897 | 14.4 | 29.5 | 2.4 | NG | Comp. ex. |
| BL-1 | BL | 1259 | 10.5 | 60.8 | 6.9 | NG | Comp. ex. |
| BM-1 | BM | 1332 | 10.7 | 61.8 | 2.4 | NG | Comp. ex. |
| BN-1 | BN | 1425 | 11.1 | 56.7 | 8.8 | NG | Comp. ex. |
| BO-1 | BO | 1129 | 12.2 | 39.3 | 9.2 | NG | Comp. ex. |
| BP-1 | BP | 1216 | 11.6 | 64.1 | 2.5 | NG | Comp. ex. |

From the results shown in Table 2-1 and Table 2-2, the following will be understood.

AN-1 was excessively small in C content in the steel, so at the time of annealing, it is believed that transformation from austenite to ferrite, pearlite, and bainite was promoted and tempered martensite and martensite became insufficient and the steel strength fell. As a result, the absorption energy at the time of axial crushing deformation of the finally obtained steel sheet fell.

AO-1 was excessively large in C content in the steel, so the area ratio of retained austenite increased and it is believed that work induced transformation occurred at a small amount of deformation at the time of crushing deformation. As a result, the absorption energy at the time of axial crushing deformation of the finally obtained steel sheet fell.

AP-1 was excessively large in Si content in the steel, so while the steel strength increased, a drop in the workability was invited and, further, it is believed that coarse oxides easily formed dispersed at the surface layer of the hot rolled steel sheet and the desired roughness became difficult to obtain at the time of hot rolling. As a result, the desired roughness could not be obtained at the surface of the finally obtained steel sheet and the absorption energy at the time of axial crushing deformation fell.

AQ-1 was excessively large in Mn content in the steel, so while the steel strength increased, a drop in the workability was invited and it is believed coarse oxides easily scattered at the surface layer of the hot rolled steel sheet and, at the time of hot rolling, the desired roughness became difficult to obtain. As a result, the desired roughness could not be formed at the surface of the finally obtained steel sheet and the absorption energy at the time of axial crushing deformation fell.

AR-1 was excessively large in P content in the steel, so while the steel strength increased, it is believed brittle fracture of the steel was invited. As a result, the absorption energy at the time of axial crushing deformation of the finally obtained steel sheet fell.

AS-1 was excessively large in S content in the steel, so at the time of hot rolling, fractures starting from nonmetallic inclusions easily formed. It is believed that in the middle of hot rolling, pieces fractured and peeled off from the steel sheet and the steel sheet surface was polished at the time of hot rolling by the iron powder generated, whereby the desired roughness became difficult to obtain at the time of hot rolling. Further, it is believed that fractures easily occurred starting from nonmetallic inclusions at the time of crushing deformation. As a result, the desired roughness could not be formed at the surface of the finally obtained steel sheet and the absorption energy at the time of axial crushing deformation fell.

AT-1 was excessively large in Al content in the steel, so in the cooling process of the annealing, ferrite transformation and bainite transformation were promoted and the steel strength fell and, further, in the middle of hot rolling, the large amounts of coarse Al oxide formed at the steel surface caused the steel sheet surface to be polished at the time of hot rolling, whereby it is believed that, at the time of hot rolling, suitable deformation became difficult and the desired roughness became difficult to obtain. As a result, the desired roughness could not be formed at the surface of the finally obtained steel sheet and the absorption energy at the time of axial crushing deformation fell.

AU-1 was excessively large in N content in the steel, so nitrides excessively formed in the steel and contact between the sheet surface and roll during hot rolling was suppressed by the nitrides, so it is believed that, the desired roughness became difficult to obtain at the time of hot rolling. As a result, the desired roughness could not be formed at the surface of the finally obtained steel sheet and the absorption energy at the time of axial crushing deformation fell.

AV-1 was excessively large in Ti content in the steel, so coarse carbides excessively formed in the steel and contact between the sheet surface and roll during hot rolling was suppressed by the carbides, so it is believed that, the desired roughness became difficult to obtain at the time of hot rolling. As a result, the desired roughness could not be formed at the surface of the finally obtained steel sheet and the absorption energy at the time of axial crushing deformation fell.

AW-1 was excessively large in Co content in the steel, so Co carbides excessively formed in the steel and contact between the sheet surface and roll during hot rolling was suppressed by the Co carbides, so it is believed that, the desired roughness became difficult to obtain at the time of hot rolling. As a result, the desired roughness could not be formed at the surface of the finally obtained steel sheet and the absorption energy at the time of axial crushing deformation fell.

AX-1 was excessively large in Ni content in the steel, so it is believed had an effect on the peelability of oxide scale at the time of hot rolling and promoted formation of flaws at the sheet surface. As a result, the desired roughness could not be formed at the surface of the finally obtained steel sheet and the absorption energy at the time of axial crushing deformation fell.

AY-1 was excessively large in Mo content in the steel, so Mo carbides excessively formed in the steel and contact between the sheet surface and roll during hot rolling was suppressed by the Mo carbides, so it is believed that, the desired roughness became difficult to obtain at the time of hot rolling. As a result, the desired roughness could not be formed at the surface of the finally obtained steel sheet and the absorption energy at the time of axial crushing deformation fell.

AZ-1 was excessively large in Cr content in the steel, so formation of retained austenite was promoted. Due to the presence of excessive retained austenite, it is believed starting points for fracture at the time of axial crushing deformation increased. As a result, the absorption energy at the time of axial crushing deformation fell.

BA-1 was excessively large in O content in the steel, so it is believed that granular coarse oxides were formed at the steel sheet surface, fracture of the steel sheet surface and formation of fine iron powder were invited during hot rolling, and the desired roughness became difficult to obtain at the time of hot rolling. As a result, the desired roughness could not be formed at the surface of the finally obtained steel sheet and the absorption energy at the time of axial crushing deformation fell.

BB-1 was excessively large in B content in the steel, so B oxides were formed in the steel and contact between the sheet surface and roll during hot rolling was suppressed by the B oxides, so it is believed that the desired roughness became difficult to obtain at the time of hot rolling. As a result, the desired roughness could not be formed at the surface of the finally obtained steel sheet and the absorption energy at the time of axial crushing deformation fell.

BC-1 was excessively large in Nb content in the steel, so large amounts of Nb carbides were formed in the steel and contact between the sheet surface and roll during hot rolling was suppressed by the Nb carbides, so it is believed that the desired roughness became difficult to obtain at the time of hot rolling. As a result, the desired roughness could not be formed at the surface of the finally obtained steel sheet and the absorption energy at the time of axial crushing deformation fell.

BD-1 was excessively large in V content in the steel, so large amounts of carbonitrides were formed in the steel and contact between the sheet surface and roll during hot rolling was suppressed by the carbonitrides, so it is believed that the desired roughness became difficult to obtain at the time of hot rolling. As a result, the desired roughness could not be formed at the surface of the finally obtained steel sheet and the absorption energy at the time of axial crushing deformation fell.

BE-1 was excessively large in Cu content in the steel, so Cu concentrated at the sheet surface and contact between the sheet surface and roll during hot rolling was suppressed by the concentrated Cu, so it is believed that the desired roughness became difficult to obtain at the time of hot rolling. As a result, the desired roughness could not be formed at the surface of the finally obtained steel sheet and the absorption energy at the time of axial crushing deformation fell.

BF-1 was excessively large in W content in the steel, so carbides were formed in the steel and contact between the sheet surface and roll during hot rolling was suppressed by the carbides, so it is believed that the desired roughness became difficult to obtain at the time of hot rolling. As a result, the desired roughness could not be formed at the surface of the finally obtained steel sheet and the absorption energy at the time of axial crushing deformation fell.

BG-1 was excessively large in Ta content in the steel, so carbides were formed in the steel and contact between the sheet surface and roll during hot rolling was suppressed by the carbides, so it is believed that the desired roughness became difficult to obtain at the time of hot rolling. As a result, the desired roughness could not be formed at the surface of the finally obtained steel sheet and the absorption energy at the time of axial crushing deformation fell.

BH-1 was excessively large in Sn content in the steel, so fracture of the steel sheet surface and formation of fine iron powder were invited during hot rolling and it is believed the desired roughness became difficult to obtain at the time of hot rolling. As a result, the desired roughness could not be formed at the surface of the finally obtained steel sheet and the absorption energy at the time of axial crushing deformation fell.

BI-1 was excessively large in Sb content in the steel, so fracture of the steel sheet surface and formation of fine iron powder were invited during hot rolling and it is believed the desired roughness became difficult to obtain at the time of hot rolling. As a result, the desired roughness could not be formed at the surface of the finally obtained steel sheet and the absorption energy at the time of axial crushing deformation fell.

BJ-1 was excessively large in As content in the steel, so fracture of the steel sheet surface and formation of fine iron powder were invited during hot rolling and it is believed the desired roughness became difficult to obtain at the time of hot rolling. As a result, the desired roughness could not be formed at the surface of the finally obtained steel sheet and the absorption energy at the time of axial crushing deformation fell.

BK-1 was excessively large in Mg content in the steel, so coarse inclusions were formed in the steel and contact between the sheet surface and roll during hot rolling was suppressed by the inclusions, so it is believed that the desired roughness became difficult to obtain at the time of hot rolling. As a result, the desired roughness could not be formed at the surface of the finally obtained steel sheet and the absorption energy at the time of axial crushing deformation fell.

BL-1 was excessively large in Ca content in the steel, so fracture of the steel sheet surface and formation of fine iron powder were invited during hot rolling and it is believed the desired roughness became difficult to obtain at the time of hot rolling. As a result, the desired roughness could not be formed at the surface of the finally obtained steel sheet and the absorption energy at the time of axial crushing deformation fell.

BM-1 was excessively large in Y content in the steel, so Y oxides were formed in the steel and contact between the sheet surface and roll during hot rolling was suppressed by the Y oxides, so it is believed that the desired roughness became difficult to obtain at the time of hot rolling. As a result, the desired roughness could not be formed at the surface of the finally obtained steel sheet and the absorption energy at the time of axial crushing deformation fell.

BN-1 was excessively large in Zr content in the steel, so Zr oxides were formed in the steel and contact between the sheet surface and roll during hot rolling was suppressed by the Zr oxides, so it is believed that the desired roughness became difficult to obtain at the time of hot rolling. As a result, the desired roughness could not be formed at the surface of the finally obtained steel sheet and the absorption energy at the time of axial crushing deformation fell.

BO-1 was excessively large in La content in the steel, so La oxides were formed in the steel and contact between the sheet surface and roll during hot rolling was suppressed by the La oxides, so it is believed that the desired roughness became difficult to obtain at the time of hot rolling. As a result, the desired roughness could not be formed at the surface of the finally obtained steel sheet and the absorption energy at the time of axial crushing deformation fell.

BP-1 was excessively large in Ce content in the steel, so Ce oxides were formed in the steel and contact between the sheet surface and roll during hot rolling was suppressed by the Ce oxides, so it is believed that the desired roughness became difficult to obtain at the time of hot rolling. As a result, the desired roughness could not be formed at the surface of the finally obtained steel sheet and the absorption energy at the time of axial crushing deformation fell.

In A-1 to AM-1, which had contents of elements within the predetermined ranges, the desired structures were obtained in the finally obtained steel sheets and the desired roughness were formed at the steel sheet surface. As a result, they were excellent in energy absorption at the time of axial crushing deformation.

Example 2

Further, to investigate the effects of the production conditions, Steel Types A to AM which were found to have excellent properties in Example 1 were subjected to work heat treatment under the production conditions described in Tables 3 to prepare thickness 1.4 mm cold rolled steel sheets which were then evaluated for properties of the steel sheets after cold rolling and annealing. Here, the steel sheets which were plated were obtained by dipping the steel sheets in a hot dip galvanization bath, then holding them at the temperatures shown in Tables 3-1 to 3-4 to prepare hot dip galvannealed steel sheets given alloyed plating layers of iron and zinc at the surfaces of the steel sheets. Further, in the annealing of the cold rolled sheets, after being held at their respective dwell temperatures, the steel sheets cooled once down to 150° C. while being cooled down to room temperature were reheated and held there for 2 seconds or more for tempering treatment. The obtained results are shown in Tables 3-1 to 3-4. Note that the methods of evaluation of the properties are similar to those of Example 1.

TABLE 3-1

| | | Production conditions | | | | | | | |
|---|---|---|---|---|---|---|---|---|---|
| No. | Steel type | Rolling reduction at one stand before final stand of finishing mill (%) | Any supply of lubricant at one stand before final stand of finishing mill | Finishing temp. of hot rolling (° C.) | Coiling temp. of hot rolled steel sheet (° C.) | Cold rolling reduction (%) | Annealing holding temp. (° C.) | Annealing holding time (s) | Cooling rate after annealing (° C./s) |
| A-2 | A | 52 | Yes | 704 | 499 | 20.7 | 875 | 215 | 37 |
| B-2 | B | 37 | Yes | 868 | 571 | 17.9 | 849 | 80 | 43 |
| C-2 | C | 57 | Yes | 705 | 268 | 5.4 | 858 | 275 | 56 |
| D-2 | D | 61 | Yes | 742 | 130 | 0.0 | 807 | 65 | 50 |
| E-2 | E | 59 | Yes | 930 | 653 | 18.5 | 841 | 152 | 20 |
| F-2 | F | 48 | Yes | 883 | 490 | 5.8 | 890 | 279 | 62 |
| G-2 | G | 50 | No | 765 | 379 | 10.3 | 839 | 102 | 84 |
| H-2 | H | 47 | Yes | 849 | 505 | 15.3 | 813 | 43 | 14 |
| I-2 | J | 53 | Yes | 752 | 541 | 18.7 | 774 | 75 | 76 |
| J-2 | J | 57 | Yes | 697 | 52 | 17.3 | 854 | 233 | 18 |
| K-2 | K | 49 | Yes | 772 | 25 | 15.2 | 842 | 47 | 64 |

TABLE 3-1-continued

| | | | | | | | | | |
|---|---|---|---|---|---|---|---|---|---|
| L-2 | L | 67 | Yes | 927 | 430 | 15.8 | 806 | 67 | 83 |
| M-2 | M | 61 | Yes | 822 | 409 | 18.3 | 786 | 266 | 54 |
| N-2 | N | 66 | Yes | 864 | 692 | 8.0 | 852 | 62 | 80 |
| O-2 | O | 33 | Yes | 743 | 490 | 6.1 | 801 | 221 | 13 |
| P-2 | P | 40 | Yes | 938 | 609 | 18.3 | 891 | 130 | 83 |
| Q-2 | Q | 45 | Yes | 788 | 278 | 17.6 | 838 | 158 | 67 |
| R-2 | R | 43 | Yes | 910 | 525 | 12.4 | 836 | 287 | 79 |
| S-2 | S | 83 | Yes | 902 | 8 | 7.6 | 805 | 97 | 70 |
| T-2 | T | 57 | Yes | 687 | 651 | 3.2 | 797 | 288 | 36 |
| U-2 | U | 61 | Yes | 668 | 235 | 4.5 | 814 | 184 | 91 |
| V-2 | V | 54 | Yes | 840 | 631 | 10.1 | 862 | 201 | 34 |
| W-2 | W | 39 | Yes | 665 | 98 | 2.1 | 785 | 117 | 41 |
| X-2 | X | 47 | Yes | 715 | 121 | 7.9 | 878 | 192 | 29 |
| Y-2 | Y | 53 | Yes | 757 | 70 | 12.3 | 762 | 100 | 64 |
| Z-2 | Z | 68 | Yes | 933 | 343 | 15.4 | 760 | 53 | 86 |
| AA-2 | AA | 42 | Yes | 881 | 416 | 7.0 | 781 | 147 | 62 |
| AB-2 | AB | 60 | Yes | 793 | 135 | 13.5 | 827 | 122 | 96 |
| AC-2 | AC | 41 | Yes | 709 | 321 | 6.6 | 860 | 206 | 47 |
| AD-2 | AD | 35 | Yes | 813 | 534 | 17.2 | 833 | 127 | 88 |
| AE-2 | AE | 34 | Yes | 862 | 575 | 9.8 | 846 | 145 | 59 |
| AF-2 | AF | 33 | Yes | 762 | 440 | 11.2 | 891 | 176 | 50 |
| AG-2 | AG | 63 | Yes | 780 | 546 | 5.8 | 787 | 245 | 95 |
| AH-2 | AH | 63 | Yes | 744 | 728 | 6.8 | 879 | 171 | 57 |
| AI-2 | AI | 58 | Yes | 816 | 109 | 23.6 | 789 | 126 | 9 |
| AJ-2 | AJ | 41 | Yes | 903 | 70 | 0.0 | 867 | 264 | 15 |
| AK-2 | AK | 56 | Yes | 740 | 610 | 1.2 | 882 | 107 | 33 |
| AL-2 | AL | 65 | Yes | 790 | 420 | 17.2 | 847 | 68 | 70 |
| AM-2 | AM | 43 | Yes | 882 | 216 | 10.1 | 878 | 157 | 40 |

| | | Production conditions | | | | | | |
|---|---|---|---|---|---|---|---|---|
| No. | Steel type | Cooling stop temp. after annealing (° C.) | Dwell temp. after annealing (° C.) | Dwell time after annealing | Tempering temp. (° C.) | Plating | Holding temp. after dipping in plating (° C.) | Skin pass rolling rate (%) |
| A-2 | A | 324 | 410 | 129 | — | Yes | — | 1.6 |
| B-2 | B | 189 | 404 | 132 | — | No | — | 1.8 |
| C-2 | C | 69 | 537 | 140 | — | Yes | — | 1.4 |
| D-2 | D | 151 | 438 | 284 | 334 | Yes | 465 | 1.3 |
| E-2 | E | 490 | 507 | 152 | — | Yes | — | 1.4 |
| F-2 | F | 252 | 450 | 257 | — | No | — | 1.1 |
| G-2 | G | 373 | 458 | 114 | — | No | — | 1.7 |
| H-2 | H | 487 | 471 | 219 | 183 | Yes | 533 | 1.2 |
| I-2 | J | 172 | 540 | 46 | 243 | No | — | 1.7 |
| J-2 | J | 133 | 450 | 130 | — | No | — | 1.1 |
| K-2 | K | 135 | 411 | 56 | — | Yes | 518 | 1.8 |
| L-2 | L | 74 | 384 | 127 | — | No | — | 1.0 |
| M-2 | M | 462 | 374 | 268 | 235 | No | — | 1.5 |
| N-2 | N | 478 | 432 | 137 | — | No | — | 1.6 |
| O-2 | O | 247 | 467 | 157 | 386 | Yes | 511 | 1.2 |
| P-2 | P | 448 | 511 | 70 | 357 | Yes | — | 1.8 |
| Q-2 | Q | 519 | 472 | 268 | 328 | No | — | 1.3 |
| R-2 | R | 196 | 388 | 284 | — | No | — | 1.4 |
| S-2 | S | 75 | 461 | 117 | — | Yes | — | 1.8 |
| T-2 | T | 354 | 514 | 172 | — | Yes | 485 | 2.0 |
| U-2 | U | 74 | 462 | 271 | 270 | Yes | 521 | 1.2 |
| V-2 | V | 168 | 357 | 205 | — | Yes | — | 1.1 |
| W-2 | W | 545 | 437 | 126 | — | No | — | 1.3 |
| X-2 | X | 259 | 387 | 169 | — | Yes | 462 | 1.4 |
| Y-2 | Y | 270 | 503 | 98 | — | Yes | 547 | 1.1 |
| Z-2 | Z | 160 | 427 | 176 | — | No | — | 1.9 |
| AA-2 | AA | 270 | 464 | 196 | 219 | Yes | — | 1.8 |
| AB-2 | AB | 464 | 521 | 230 | 271 | Yes | 503 | 1.8 |
| AC-2 | AC | 307 | 384 | 275 | 217 | Yes | — | 1.7 |
| AD-2 | AD | 371 | 536 | 228 | 325 | Yes | 526 | 1.1 |
| AE-2 | AE | 205 | 499 | 115 | — | Yes | 520 | 1.5 |
| AF-2 | AF | 190 | 360 | 74 | 195 | No | — | 1.4 |
| AG-2 | AG | 506 | 451 | 53 | — | Yes | 506 | 1.6 |
| AH-2 | AH | 457 | 521 | 200 | — | No | — | 1.2 |
| AI-2 | AI | 111 | 508 | 54 | — | Yes | 522 | 1.9 |
| AJ-2 | AJ | 405 | 496 | 217 | 297 | No | — | 1.8 |
| AK-2 | AK | 237 | 423 | 103 | 179 | No | — | 1.5 |
| AL-2 | AL | 317 | 528 | 283 | 364 | Yes | 478 | 1.9 |
| AM-2 | AM | 394 | 520 | 189 | 358 | No | — | 1.7 |

TABLE 3-2

| No. | Area ratios of structures of cold rolled and annealed sheets (%) | | | | Tensile properties | | | Properties | | Re-marks |
|---|---|---|---|---|---|---|---|---|---|---|
| | Total of ferrite, pearlite, and bainite | Retained austenite | Tempered martensite | Martensite | Tensile strength TS (MPa) | Total elongation t-El (%) | Hole expandability λ (%) | Interval of step differences having height difference of more than 5.0 μm at sheet surface (mm) | Absorption energy at axial crushing | |
| A-2 | 30.2 | 0.0 | 2.9 | 66.9 | 1027 | 12.4 | 29.4 | 8.6 | NG | Comp. ex. |
| B-2 | 34.5 | 0.0 | 0.3 | 65.2 | 1176 | 11 | 24.9 | 1.4 | OK | Inv. ex. |
| C-2 | 5.7 | 0.0 | 0.0 | 94.3 | 1213 | 11.4 | 58.7 | 0.5 | OK | Inv. ex. |
| D-2 | 25.2 | 0.0 | 0.5 | 74.3 | 1297 | 11.1 | 30.9 | 0.3 | OK (fair) | Inv. ex. |
| E-2 | 59.2 | 0.0 | 0.6 | 40.2 | 983 | 12.9 | 22.1 | 1.7 | OK | Inv. ex. |
| F-2 | 45.5 | 0.0 | 2.6 | 51.9 | 1168 | 12.5 | 20.4 | 1.2 | OK | Inv. ex. |
| G-2 | 29.4 | 0.0 | 18.7 | 51.9 | 1095 | 12.1 | 29.5 | 7.6 | NG | Comp. ex. |
| H-2 | 33.3 | 0.0 | 0.1 | 66.6 | 1174 | 12.1 | 25.7 | 0.7 | OK | Inv. ex. |
| I-2 | 36.4 | 0.0 | 0.7 | 62.9 | 1107 | 12.1 | 24.1 | 1.5 | OK | Inv. ex. |
| J-2 | 39.2 | 0.0 | 0.1 | 60.7 | 1098 | 12.8 | 22.6 | 0.8 | OK | Inv. ex. |
| K-2 | 3.9 | 0.0 | 0.2 | 95.9 | 1354 | 9.5 | 55.0 | 1.4 | OK | Inv. ex. |
| L-2 | 57.9 | 0.0 | 0.1 | 42.0 | 1012 | 14.4 | 21.5 | 0.4 | OK | Inv. ex. |
| M-2 | 58.6 | 0.0 | 0.6 | 40.8 | 970 | 13.6 | 21.9 | 1.4 | OK | Inv. ex. |
| N-2 | 59.3 | 0.1 | 0.1 | 40.5 | 1091 | 13.7 | 21.9 | 1.3 | OK | Inv. ex. |
| O-2 | 56.1 | 0.1 | 3.4 | 40.4 | 1062 | 12.8 | 20.9 | 0.8 | OK | Inv. ex. |
| P-2 | 1.4 | 0.0 | 0.1 | 98.5 | 1351 | 10.9 | 59.1 | 1.1 | OK | Inv. ex. |
| Q-2 | 11.1 | 0.0 | 0.8 | 88.1 | 1315 | 10.5 | 46.3 | 0.9 | OK | Inv. ex. |
| R-2 | 25.9 | 0.0 | 0.6 | 73.5 | 1117 | 13.4 | 32.7 | 1.5 | OK | Inv. ex. |
| S-2 | 1.5 | 0.0 | 0.1 | 98.4 | 1405 | 8.8 | 56.0 | 5.5 | NG | Comp. ex. |
| T-2 | 27.3 | 0.0 | 41.0 | 31.7 | 1046 | 13.5 | 32.1 | 1.9 | OK | Inv. ex. |
| U-2 | 59.7 | 0.1 | 0.1 | 40.1 | 1015 | 12.9 | 22.3 | 0.7 | OK | Inv. ex. |
| V-2 | 31 | 0.0 | 0.6 | 68.4 | 1144 | 12.9 | 27.7 | 1.7 | OK | Inv. ex. |
| W-2 | 56.4 | 0.0 | 0.4 | 43.2 | 988 | 14.3 | 21.0 | 1.2 | OK | Inv. ex. |
| X-2 | 13.1 | 0.0 | 1.4 | 85.5 | 1197 | 11.3 | 47.3 | 1.8 | OK | Inv. ex. |
| Y-2 | 30.7 | 0.0 | 8.6 | 60.7 | 1153 | 10.8 | 27.9 | 0.8 | OK | Inv. ex. |
| Z-2 | 32.6 | 0.1 | 1.3 | 66.0 | 1193 | 11.6 | 26.1 | 0.9 | OK | Inv. ex. |
| AA-2 | 34.4 | 0.1 | 15.3 | 50.2 | 1169 | 12.7 | 25.0 | 0.6 | OK | Inv. ex. |
| AB-2 | 49.1 | 0.0 | 0.7 | 50.2 | 1051 | 14.4 | 20.0 | 1.3 | OK | Inv. ex. |
| AC-2 | 23.4 | 0.0 | 2.4 | 74.2 | 1063 | 13 | 36.4 | 1.4 | OK | Inv. ex. |
| AD-2 | 59.7 | 0.1 | 0.2 | 40.0 | 1056 | 14.9 | 22.2 | 1.4 | OK | Inv. ex. |
| AE-2 | 20.7 | 0.0 | 0.4 | 78.9 | 1251 | 10.7 | 36.2 | 1.3 | OK | Inv. ex. |
| AF-2 | 1 | 0.0 | 0.5 | 98.5 | 1225 | 12.1 | 66.6 | 1.9 | OK | Inv. ex. |

TABLE 3-2-continued

| No. | Area ratios of structures of cold rolled and annealed sheets (%) | | | | Tensile properties | | | Properties | | Re-marks |
|---|---|---|---|---|---|---|---|---|---|---|
| | Total of ferrite, pearlite, and bainite | Retained austenite | Tempered martensite | Martensite | Tensile strength TS (MPa) | Total elongation t-El (%) | Hole expandability λ (%) | Interval of step differences having height difference of more than 5.0 μm at sheet surface (mm) | Absorp-tion energy at axial crushing | |
| AG-2 | 3.7 | 0.0 | 0.9 | 95.4 | 1257 | 10.7 | 60.1 | 1.6 | OK | Inv. ex. |
| AH-2 | 0.4 | 0.0 | 0.4 | 99.2 | 1254 | 10.5 | 66.2 | 9.8 | NG | Comp. ex. |
| AI-2 | 24.1 | 0.1 | 0.4 | 75.4 | 1261 | 11.2 | 32.5 | 8.1 | NG | Comp. ex. |
| AJ-2 | 29.1 | 0.0 | 69.8 | 1.1 | 845 | 13.9 | 32.3 | 0.7 | OK (fair) | Inv. ex. |
| AK-2 | 4.5 | 0.0 | 2.8 | 92.7 | 1385 | 10.7 | 52.6 | 1.3 | OK | Inv. ex. |
| AL-2 | 0.1 | 0.0 | 19.3 | 80.6 | 1243 | 11.5 | 67.4 | 0.8 | OK | Inv. ex. |
| AM-2 | 56.7 | 0.0 | 0.2 | 43.1 | 1050 | 15.2 | 21.1 | 0.8 | OK | Inv. ex. |

TABLE 3-3

| No | Steel type | Production conditions | | | | | | | |
|---|---|---|---|---|---|---|---|---|---|
| | | Rolling reduction at one stand before final stand of finishing mill (%) | Any supply of lubricant at one stand before final stand of finishing mill | Finishing temp. of hot rolling (° C.) | Coiling temp. of hot rolled steel sheet (° C.) | Cold rolling reduction (%) | Annealing holding temp. (° C.) | Annealing holding time (s) | Cooling rate after annealing (° C./s) |
| A-3 | A | 57 | Yes | 708 | 427 | 11.1 | 879 | 85 | 96 |
| B-3 | B | 45 | Yes | 838 | 459 | 2.5 | 823 | 97 | 36 |
| C-3 | C | 63 | Yes | 794 | 295 | 4.3 | 895 | 183 | 86 |
| D-3 | D | 49 | Yes | 679 | 538 | 16.3 | 822 | 59 | 47 |
| E-3 | E | 45 | Yes | 684 | 199 | 19.4 | 832 | 190 | 26 |
| F-3 | F | 38 | Yes | 862 | 147 | 3.5 | 859 | 137 | 33 |
| G-3 | G | 47 | Yes | 778 | 490 | 6.5 | 863 | 142 | 37 |
| H-3 | H | 68 | Yes | 662 | 215 | 12.7 | 792 | 35 | 10 |
| I-3 | I | 59 | Yes | 668 | 591 | 1.5 | 798 | 158 | 74 |
| J-3 | J | 33 | Yes | 702 | 189 | 2.5 | 801 | 173 | 27 |
| K-3 | K | 66 | Yes | 727 | 218 | 11.1 | 870 | 178 | 62 |
| L-3 | L | 61 | Yes | 772 | 395 | 18.1 | 858 | 112 | 28 |
| M-3 | M | 37 | Yes | 733 | 588 | 1.8 | 896 | 35 | 86 |
| N-3 | N | 29 | Yes | 812 | 417 | 3.6 | 893 | 239 | 73 |
| O-3 | O | 41 | Yes | 908 | 740 | 16.7 | 791 | 224 | 27 |
| P-3 | P | 62 | Yes | 679 | 278 | 3.0 | 785 | 261 | 23 |
| Q-3 | Q | 45 | Yes | 896 | 186 | 12.9 | 861 | 82 | 43 |
| R-3 | R | 38 | Yes | 677 | 652 | 15.9 | 870 | 140 | 4 |
| S-3 | S | 53 | Yes | 866 | 373 | 14.0 | 837 | 149 | 69 |
| T-3 | T | 22 | Yes | 848 | 359 | 4.9 | 798 | 45 | 27 |
| U-3 | U | 38 | Yes | 875 | 585 | 17.3 | 851 | 288 | 25 |
| V-3 | V | 50 | Yes | 733 | 373 | 1.6 | 847 | 250 | 67 |
| W-3 | W | 69 | Yes | 696 | 597 | 13.0 | 839 | 267 | 95 |
| X-3 | X | 67 | Yes | 891 | 343 | 2.8 | 775 | 229 | 71 |
| Y-3 | Y | 65 | Yes | 831 | 274 | 12.8 | 785 | 234 | 73 |
| Z-3 | Z | 42 | Yes | 883 | 508 | 2.0 | 803 | 267 | 77 |
| AA-3 | AA | 45 | Yes | 854 | 111 | 13.3 | 873 | 210 | 88 |
| AB-3 | AB | 71 | Yes | 911 | 11 | 10.7 | 821 | 238 | 27 |
| AC-3 | AC | 52 | Yes | 788 | 445 | 10.4 | 869 | 245 | 50 |
| AD-3 | AD | 55 | Yes | 832 | 586 | 8.1 | 874 | 67 | 18 |
| AE-3 | AE | 51 | Yes | 870 | 675 | 13.9 | 866 | 279 | 50 |
| AF-3 | AF | 37 | Yes | 822 | 180 | 8.7 | 822 | 84 | 12 |
| AG-3 | AG | 67 | Yes | 807 | 171 | 15.3 | 790 | 108 | 13 |
| AH-3 | AH | 33 | Yes | 657 | 226 | 16.9 | 788 | 247 | 93 |
| AI-3 | AI | 35 | Yes | 918 | 677 | 18.2 | 867 | 159 | 22 |
| AJ-3 | AJ | 35 | Yes | 815 | 172 | 4.5 | 885 | 198 | 4 |

TABLE 3-3-continued

| | | | | | | | | | | |
|---|---|---|---|---|---|---|---|---|---|---|
| AK-3 | AK | 51 | | Yes | 773 | 315 | 0.4 | 859 | 206 | 58 |
| AL-3 | AL | 48 | | Yes | 760 | 556 | 14.8 | 795 | 96 | 52 |
| AM-3 | AM | 65 | | Yes | 712 | 362 | 12.0 | 886 | 218 | 51 |

| | | Production conditions | | | | | | |
|---|---|---|---|---|---|---|---|---|
| No | Steel type | Cooling stop temp. after annealing (° C.) | Dwell temp. after annealing (° C.) | Dwell time after annealing | Tempering temp. (° C.) | Plating | Holding temp. after dipping in plating (° C.) | Skin pass rolling rate (%) |
| A-3 | A | 241 | 489 | 214 | — | No | — | 1.1 |
| B-3 | B | 394 | 482 | 75 | — | Yes | — | 1.9 |
| C-3 | C | 106 | 377 | 191 | — | Yes | — | 1.5 |
| D-3 | D | 445 | 375 | 111 | 339 | No | — | 1.3 |
| E-3 | E | 429 | 496 | 162 | — | No | — | 2.0 |
| F-3 | F | 203 | 519 | 138 | — | No | — | 1.3 |
| G-3 | G | 329 | 431 | 247 | — | No | — | 1.8 |
| H-3 | H | 239 | 376 | 284 | — | No | — | 1.8 |
| I-3 | I | 238 | 442 | 102 | 279 | No | — | 1.6 |
| J-3 | J | 209 | 419 | 247 | 281 | No | — | 1.6 |
| K-3 | K | 356 | 390 | 85 | — | No | — | 2.0 |
| L-3 | L | 275 | 485 | 204 | — | No | — | 1.8 |
| M-3 | M | 289 | 509 | 256 | — | No | — | 1.6 |
| N-3 | N | 384 | 359 | 149 | — | No | — | 1.6 |
| O-3 | O | 286 | 453 | 161 | — | No | — | 1.1 |
| P-3 | P | 194 | 531 | 155 | — | No | — | 1.7 |
| Q-3 | Q | 135 | 458 | 101 | — | Yes | — | 1.4 |
| R-3 | R | 52 | 373 | 267 | — | Yes | 553 | 1.3 |
| S-3 | S | 429 | 533 | 117 | 232 | Yes | 451 | 1.1 |
| T-3 | T | 440 | 482 | 290 | — | Yes | 495 | 1.2 |
| U-3 | U | 48 | 430 | 79 | 371 | Yes | 442 | 1.1 |
| V-3 | V | 420 | 475 | 173 | 383 | No | — | 1.0 |
| W-3 | W | 258 | 368 | 72 | — | No | — | 1.4 |
| X-3 | X | 39 | 368 | 48 | 178 | Yes | — | 1.5 |
| Y-3 | Y | 495 | 507 | 223 | — | No | — | 1.9 |
| Z-3 | Z | 526 | 394 | 107 | — | Yes | — | 1.4 |
| AA-3 | AA | 180 | 362 | 179 | — | Yes | — | 1.3 |
| AB-3 | AB | 101 | 398 | 61 | — | Yes | 555 | 1.6 |
| AC-3 | AC | 511 | 437 | 249 | 220 | No | — | 1.6 |
| AD-3 | AD | 52 | 408 | 220 | 164 | No | — | 1.2 |
| AE-3 | AE | 134 | 435 | 218 | — | No | — | 1.9 |
| AF-3 | AF | 50 | 520 | 230 | — | Yes | — | 1.3 |
| AG-3 | AG | 99 | 453 | 53 | 302 | No | — | 1.5 |
| AH-3 | AH | 397 | 416 | 178 | — | No | — | 1.7 |
| AI-3 | AI | 425 | 430 | 181 | — | No | — | 1.5 |
| AJ-3 | AJ | 311 | 411 | 169 | — | No | — | 1.6 |
| AK-3 | AK | 529 | 476 | 289 | 205 | No | — | 1.3 |
| AL-3 | AL | 75 | 493 | 266 | — | Yes | 468 | 1.2 |
| AM-3 | AM | 202 | 534 | 37 | — | Yes | — | 1.5 |

TABLE 3-4

| | Area ratios of structures of cold rolled and annealed sheets (%) | | | | Tensile properties | | | Properties | | |
|---|---|---|---|---|---|---|---|---|---|---|
| No. | Total of ferrite, pearlite, and bainite | Retained austenite | Tempered martensite | Martensite | Tensile strength TS (MPa) | Total elongation t-El (%) | Hole expandability λ (%) | Interval of step differences having height difference of more than 5.0 μm at sheet surface (mm) | Absorption energy at axial crushing | Remarks |
| A-3 | 14.5 | 0.0 | 0.4 | 85.1 | 1135 | 11.4 | 47.1 | 1.3 | OK | Inv. ex. |
| B-3 | 44.4 | 0.0 | 35.1 | 20.5 | 893 | 13.9 | 20.8 | 0.9 | OK | Inv. ex. |
| C-3 | 3.9 | 0.0 | 0.0 | 96.1 | 1227 | 11.3 | 61.2 | 1.4 | OK | Inv. ex. |
| D-3 | 12.7 | 0.0 | 0.4 | 86.9 | 1372 | 10.6 | 42.3 | 0.9 | OK | Inv. ex. |
| E-3 | 57.9 | 0.0 | 41.9 | 0.2 | 673 | 18.0 | 22.0 | 0.4 | OK | Inv. ex. |

TABLE 3-4-continued

| No. | Area ratios of structures of cold rolled and annealed sheets (%) | | | | Tensile properties | | | Properties | | Re-marks |
|---|---|---|---|---|---|---|---|---|---|---|
| | Total of ferrite, pearlite, and bainite | Retained austenite | Tempered martensite | Martensite | Tensile strength TS (MPa) | Total elongation t-El (%) | Hole expandability λ (%) | Interval of step differences having height difference of more than 5.0 μm at sheet surface (mm) | Absorption energy at axial crushing | |
| F-3 | 59.9 | 0.1 | 1.7 | 38.3 | 1095 | 13.2 | 22.2 | 1.5 | OK | Inv. ex. |
| G-3 | 33.4 | 0.0 | 5.9 | 60.7 | 1122 | 11.9 | 26.0 | 1.3 | OK | Inv. ex. |
| H-3 | 46.2 | 0.0 | 3.9 | 49.9 | 1097 | 12.8 | 20.3 | 1.8 | OK | Inv. ex. |
| I-3 | 15.6 | 0.0 | 2.6 | 81.8 | 1214 | 11.3 | 43.3 | 0.7 | OK | Inv. ex. |
| J-3 | 58.4 | 0.0 | 1.7 | 39.9 | 989 | 14 | 21.8 | 1.9 | OK | Inv. ex. |
| K-3 | 4.1 | 0.0 | 29.8 | 66.1 | 1286 | 9.9 | 58.0 | 1.5 | OK | Inv. ex. |
| L-3 | 35.4 | 0.0 | 2.9 | 61.7 | 1121 | 13.2 | 24.7 | 0.5 | OK | Inv. ex. |
| M-3 | 10.3 | 0.0 | 2.7 | 87.0 | 1258 | 10.9 | 49.4 | 0.6 | OK | Inv. ex. |
| N-3 | 48.5 | 0.0 | 0.6 | 50.9 | 1143 | 13.2 | 20.0 | 6.6 | NG | Comp. ex. |
| O-3 | 56.8 | 0.1 | 9.6 | 33.5 | 1009 | 13.4 | 21.1 | 7.5 | NG | Comp. ex. |
| P-3 | 41.2 | 0.0 | 1.7 | 57.1 | 1136 | 12.6 | 21.7 | 0.8 | OK | Inv. ex. |
| Q-3 | 2.1 | 0.0 | 0.3 | 97.6 | 1372 | 10.1 | 56.9 | 1.2 | OK | Inv. ex. |
| R-3 | 18.4 | 0.0 | 0.0 | 81.6 | 1164 | 12.9 | 40.8 | 0.9 | OK | Inv. ex. |
| S-3 | 1.5 | 0.0 | 0.5 | 98.0 | 1403 | 8.9 | 56.1 | 0.4 | OK | Inv. ex. |
| T-3 | 27.5 | 0.0 | 0.9 | 71.6 | 1121 | 12.7 | 31.0 | 5.6 | NG | Comp. ex. |
| U-3 | 59.3 | 0.1 | 0.0 | 40.6 | 1016 | 12.8 | 22.1 | 1.5 | OK | Inv. ex. |
| V-3 | 37.7 | 0.0 | 0.8 | 61.5 | 1099 | 13.3 | 23.4 | 1.6 | OK | Inv. ex. |
| W-3 | 18.9 | 0.0 | 1.9 | 79.2 | 1198 | 12.2 | 39.4 | 1.8 | OK | Inv. ex. |
| X-3 | 58 | 0.0 | 0.0 | 42.0 | 932 | 13.9 | 21.7 | 1.1 | OK | Inv. ex. |
| Y-3 | 10.1 | 0.0 | 0.8 | 89.1 | 1318 | 9.7 | 47.6 | 1.9 | OK | Inv. ex. |
| Z-3 | 0.2 | 0.0 | 0.3 | 99.5 | 1361 | 10.4 | 60.5 | 1.6 | OK | Inv. ex. |
| AA-3 | 0.5 | 0.0 | 1.3 | 98.2 | 1413 | 10.8 | 57.1 | 1.8 | OK | Inv. ex. |
| AB-3 | 53.7 | 0.0 | 0.1 | 46.2 | 1029 | 14.7 | 20.3 | 6.9 | NG | Comp. ex. |
| AC-3 | 17.7 | 0.0 | 0.3 | 82.0 | 1098 | 12.7 | 43.3 | 1.4 | OK | Inv. ex. |
| AD-3 | 51.3 | 0.0 | 0.0 | 48.7 | 1099 | 14.4 | 20.0 | 1.5 | OK | Inv. ex. |
| AE-3 | 23.4 | 0.0 | 0.1 | 76.5 | 1233 | 10.8 | 33.6 | 0.8 | OK | Inv. ex. |
| AF-3 | 28.3 | 0.0 | 0.0 | 71.7 | 1088 | 13.3 | 30.6 | 0.9 | OK | Inv. ex. |
| AG-3 | 0.7 | 0.0 | 0.1 | 99.2 | 1280 | 10.5 | 64.1 | 1.5 | OK | Inv. ex. |
| AH-3 | 11.9 | 0.0 | 1.0 | 87.1 | 1183 | 11 | 49.6 | 1.6 | OK | Inv. ex. |
| AI-3 | 1.1 | 0.0 | 0.7 | 98.2 | 1381 | 10.4 | 57.9 | 0.7 | OK | Inv. ex. |
| AJ-3 | 56.8 | 0.1 | 7.9 | 35.2 | 1000 | 12.1 | 21.1 | 0.8 | OK | Inv. ex. |
| AK-3 | 2.6 | 0.0 | 0.2 | 97.2 | 1396 | 10.6 | 54.8 | 1.4 | OK | Inv. ex. |

TABLE 3-4-continued

| No. | Area ratios of structures of cold rolled and annealed sheets (%) | | | | Tensile properties | | | Properties | | Re-marks |
|---|---|---|---|---|---|---|---|---|---|---|
| | Total of ferrite, pearlite, and bainite | Retained austenite | Tempered martensite | Martensite | Tensile strength TS (MPa) | Total elongation t-El (%) | Hole expandability λ (%) | Interval of step differences having height difference of more than 5.0 μm at sheet surface (mm) | Absorption energy at axial crushing | |
| AL-3 | 29.4 | 0.0 | 0.1 | 70.5 | 1105 | 12.7 | 29.4 | 1.7 | OK | Inv. ex. |
| AM-3 | 53.4 | 0.0 | 1.5 | 45.1 | 1053 | 15.1 | 20.3 | 1.4 | OK | Inv. ex. |

From the results shown in Tables 3-1 to 3-4, the following will be understood.

Each of A-2 and AI-2 was excessively large in rolling reduction in the cold rolling, so it is believed that the projecting parts of the roughness formed at the surface of the sheet due to hot rolling were crushed by the cold rolling. As a result, the desired roughness could not be formed at the surface of the finally obtained steel sheet and the absorption energy at the time of axial crushing deformation fell.

G-2 did not have lubricant supplied at one stand before the final stand of the finishing mill in the hot rolling, so it is believed that sliding became difficult between the sheet and roll. As a result, the desired roughness could not be formed at the surface of the finally obtained steel sheet and the absorption energy at the time of axial crushing deformation fell.

Each of S-2 and AB-3 was excessively large in rolling reduction at one stand before the final stand of the finishing mill in the hot rolling, so it is believed that at the time of hot rolling, the surface pressure between the sheet and roll during rolling became excessively high and the frequency of contact between the sheet and roll was higher than sliding. As a result, the desired roughness could not be formed at the surface of the finally obtained steel sheet and the absorption energy at the time of axial crushing deformation fell.

Each of AH-2 and O-3 was excessively high in temperature at the time of coiling the hot rolled steel sheet, so it is believed that the oxide scale formed at the surface of the hot rolled steel sheet became remarkably thick, the projecting parts of the roughness formed at the surface of the hot rolled steel sheet due to the hot rolling were taken into the oxide scale, and the projecting parts were lost by the scale being removed by the following pickling. As a result, the desired roughness could not be formed at the surface of the finally obtained steel sheet and the absorption energy at the time of axial crushing deformation fell.

Each of N-3 and T-3 was excessively small in rolling reduction at one stand before the final stand in the finishing mill in the hot rolling, so it is believed that the surface pressure between the sheet and roll at the time of hot rolling was insufficient and roughness became difficult to form. As a result, the desired roughness could not be formed at the surface of the finally obtained steel sheet and the absorption energy at the time of axial crushing deformation fell.

From the results of Example 1 and Example 2, it was learned that the steel sheet satisfying the following requirements (I) to (III) was excellent in energy absorption at the time of crushing deformation.

(I) Having a chemical composition containing, by mass %, C: 0.05 to 0.15%, Si: 0.01 to 2.00%, Mn: 0.10 to 4.00%, P: 0.0200% or less, S: 0.0200% or less, Al: 0.001 to 1.000%, N: 0.0200% or less, Ti: 0 to 0.500%, Co: 0 to 0.500%, Ni: 0 to 0.500%, Mo: 0 to 0.500%, Cr: 0 to 2.000%, O: 0 to 0.0100%, B: 0 to 0.0100%, Nb: 0 to 0.500%, V: 0 to 0.500%, Cu: 0 to 0.500%, W: 0 to 0.1000%, Ta: 0 to 0.1000%, Sn: 0 to 0.0500%, Sb: 0 to 0.0500%, As: 0 to 0.0500%, Mg: 0 to 0.0500%, Ca: 0 to 0.0500%, Y: 0 to 0.0500%, Zr: 0 to 0.0500%, La: 0 to 0.0500%, Ce: 0 to 0.0500% and a balance of Fe and impurities.

(II) Having a microstructure comprised of, by area ratio, a total of ferrite, pearlite, and bainite: 0% or more and 60.0% or less, retained austenite: 0% or more and 1.0% or less, and a balance of martensite and tempered martensite.

(III) Having on the sheet surface a plurality of step differences having height differences of more than 5.0 μm at intervals of 2.0 mm or less.

Further, it was learned that steel sheet satisfying the above requirements (I) to (III) can be produced by an integrated production process characterized by modifying the hot rolling conditions to increase the roughness of the surface of the hot rolled steel sheet and proceeding through the annealing step without completely flattening the roughness. Specifically, it can be said possible to produce that steel sheet by the following method of production.

A method of production of steel sheet, the method comprising:

hot rolling a steel slab having a chemical composition according to the above (I) to obtain a hot rolled steel sheet, coiling the hot rolled steel sheet, pickling the hot rolled steel sheet, and annealing the hot rolled steel sheet without cold rolling or annealing it after cold rolling, wherein the hot rolling includes supplying a lubricant between a rolling roll and sheet while rolling the sheet by a rolling reduction of more than 30% and 70% or less at one stand before a final stand of a finishing mill, a temperature when coiling the hot rolled steel sheet is 700° C. or less, and when performing cold rolling, a rolling reduction in the cold rolling is 0.1 to 20%.

The invention claimed is:

1. A steel sheet having a chemical composition containing, by mass %,

C: 0.05 to less than 0.15%,

Si: 0.01 to 2.00%,

Mn: 0.10 to 4.00%,

P: 0.0200% or less,

S: 0.0200% or less,
Al: 0.001 to 1.000%,
N: 0.0200% or less,
Ti: 0 to 0.500%,
Co: 0 to 0.500%,
Ni: 0 to 0.500%,
Mo: 0 to 0.500%,
Cr: 0 to 2.000%,
O: 0 to 0.0100%,
B: 0 to 0.0100%,
Nb: 0 to 0.500%,
V: 0 to 0.500%,
Cu: 0 to 0.500%,
W: 0 to 0.1000%,
Ta: 0 to 0.1000%,
Sn: 0 to 0.0500%,
Sb: 0 to 0.0500%,
As: 0 to 0.0500%,
Mg: 0 to 0.0500%,
Ca: 0 to 0.0500%,
Y: 0 to 0.0500%,
Zr: 0 to 0.0500%,
La: 0 to 0.0500%,
Ce: 0 to 0.0500% and
a balance of Fe and impurities, having a microstructure comprised of, by area ratio, a total of ferrite, pearlite, and bainite: 0% or more and 60.0% or less, retained austenite: 0% or more and 1.0% or less, and a balance of martensite and tempered martensite, and having on the sheet surface a plurality of step differences having height differences of more than 5.0 μm at intervals of 2.0 mm or less.

2. The steel sheet according to claim 1, having the chemical composition containing, by mass %, one or more of Ti: 0.001 to 0.500%, Co: 0.001 to 0.500%, Ni: 0.001 to 0.500%, Mo: 0.001 to 0.500%, Cr: 0.001 to 2.000% O: 0.0001 to 0.0100% B: 0.0001 to 0.0100%, Nb: 0.001 to 0.500%, V: 0.001 to 0.500%, Cu: 0.001 to 0.500%, W: 0.0001 to 0.1000%, Ta: 0.0001 to 0.1000%, Sn: 0.0001 to 0.0500%, Sb: 0.0001 to 0.0500%, As: 0.0001 to 0.0500%, Mg: 0.0001 to 0.0500%, Ca: 0.0001 to 0.0500%, Y: 0.0001 to 0.0500%, Zr: 0.0001 to 0.0500%, La: 0.0001 to 0.0500%, and Ce: 0.0001 to 0.0500%.

3. A method of production of steel sheet, the method comprising:

hot rolling a steel slab having a chemical composition according to claim 1 to obtain a hot rolled steel sheet, coiling the hot rolled steel sheet, pickling the hot rolled steel sheet, and annealing the hot rolled steel sheet without cold rolling or annealing it after cold rolling, wherein the hot rolling includes supplying a lubricant between a rolling roll and the sheet while rolling the sheet by a rolling reduction of more than 30% and 70% or less at one stand before a final stand of a finishing mill, a temperature when coiling the hot rolled steel sheet is 700° C. or less, and when performing cold rolling, a rolling reduction in the cold rolling is 0.1 to 20%.

4. The method of production according to claim 3, further comprising, in the annealing, forming coated layers comprised of zinc, aluminum, magnesium, or alloys of the same on the front and back surfaces of the sheet.

5. A method of production of steel sheet, the method comprising:

hot rolling a steel slab having a chemical composition according to claim 2 to obtain a hot rolled steel sheet, coiling the hot rolled steel sheet, pickling the hot rolled steel sheet, and annealing the hot rolled steel sheet without cold rolling or annealing it after cold rolling, wherein the hot rolling includes supplying a lubricant between a rolling roll and the sheet while rolling the sheet by a rolling reduction of more than 30% and 70% or less at one stand before a final stand of a finishing mill, a temperature when coiling the hot rolled steel sheet is 700° C. or less, and when performing cold rolling, a rolling reduction in the cold rolling is 0.1 to 20%.

6. The method of production according to claim 5, further comprising, in the annealing, forming coated layers comprised of zinc, aluminum, magnesium, or alloys of the same on the front and back surfaces of the sheet.

* * * * *